United States Patent [19]

Nelson

[11] 4,121,931

[45] Oct. 24, 1978

[54] ELECTROGRAPHIC DEVELOPMENT PROCESS

[75] Inventor: Kerry S. Nelson, Shoreview, Minn.

[73] Assignee: Minnesota Mining and Manufacturing Company, St. Paul, Minn.

[21] Appl. No.: 701,113

[22] Filed: Jun. 30, 1976

[51] Int. Cl.[2] ..... G03G 13/09

[52] U.S. Cl. ..... 96/1 SD; 427/18; 118/657; 118/658; 96/1 R

[58] Field of Search ..... 96/1 SD, 1 R; 427/14, 427/18

[56] References Cited

U.S. PATENT DOCUMENTS

| | | | |
|---|---|---|---|
| 3,645,770 | 2/1972 | Flint | 96/1.5 D |
| 3,900,001 | 8/1975 | Frazer et al. | 427/18 |
| 3,909,258 | 9/1975 | Kotz | 96/1.5 D |

OTHER PUBLICATIONS

IBM Technical Disclosure Bulletin, "Development of Electrostatic Images," R. M. Schaffert, vol. 1, No. 3, Oct., 1958.

*Primary Examiner*—Roland E. Martin, Jr.
*Attorney, Agent, or Firm*—Cruzan Alexander; Donald M. Sell; Robert L. Marben

[57] ABSTRACT

A method using a one-component developer of magnetically attractable, electrically insulating toner particles for developing an electrical potential pattern at a surface. Electrical means and an electrode-developer transport means are provided with the electrode-developer transport means positioned relative to the electrical potential pattern for establishing a unidirectional electrical difference between the potential pattern and an electrically conductive portion provided by the electrode-developer transport means. Rapid turbulent physical mixing action of the toner is provided for producing sufficient repetitive electrical contact of the toner with the electrically conductive portion to cause electrical charge of a predetermined polarity to be injected onto the toner particles. A charge level is so produced, which is sufficient to cause such charged toner particles to be deposited on the potential pattern bearing surface in accordance with the potential pattern.

19 Claims, 12 Drawing Figures

ELECTROGRAPHIC DEVELOPMENT PROCESS

BACKGROUND OF THE INVENTION

1. Field of the Invention

The invention presented herein relates broadly to a process using a dry developer for the development of an electrical potential pattern presented at a surface of a receptor having application in the fields of electrographics and electrophotography and particularly to a process using a dry one-component developer of magnetically attractable, electrically insulating toner particles of develop an electrical potential pattern presented at the surface of a receptor wherein electrical charging of the toner particles is accomplished by direct injection of electrical charge onto the insulating toner particles from an electrode in an electric field rather than by inductive, triboelectric or other electrostatic means.

2. Discussion of the Prior Art

Many electrographic copying processes in use today involve the creation of an electrical potential pattern or image on a surface of a suitable receptor. One method of forming such an electrical potential pattern involves placing a uniform charge on a photoconductive insulating surface provided by the receptor and dissipating the charge selectively by exposure to a pattern of light and shadow to be reproduced. Another method utilizes electrically conductive pins or styli to generate an image-wise pattern of electrostatic charge on the surface of a dielectric provided by the receptor. Whether formed by these or some other methods, the electrical potential pattern is generally developed, i.e., made visible, by deposition of toner particles provided by the developer on the receptor according to forces generated by such electrical potential patterns. The developed image may then be fixed in place or transferred to a final support material, such as paper, and fixed thereto to form a permanent record of the developed potential pattern.

Presently, several techniques which employ a developer having finely divided dry toner particles can be used to develop the latent electrical potential pattern. These techniques can be broadly classified according to whether the toner particles are controllably and effectively charged by triboelectric means, inductive means or electrostatic means.

The two most common development techniques which employ triboelectric means to charge toner particles are called cascade development and magnetic brush development. Each technique utilizes a two-component developer comprised of finely divided insulating particles, generally referred to as toner, and relatively coarser particles of another composition, generally referred to as carrier. When the fine toner particles are brought into rubbing contact with the relatively coarse carrier particles, the toner particles become triboelectrically charged to a polarity opposite to that of the carrier particles and, thus, cling to the surface of the carrier particles. In conventional cascade development, the toner-carrier mixture is poured or cascaded over the electrical potential pattern bearing member and the triboelectrically charged toner particles deposit preferentially in regions of the surface where there is a preponderance of charge of the opposite polarity. In magnetic brush development, magnetically attractable carrier particles are generally employed and a magnetic force is used to provide adherence of the toner-carrier mixture to a support member. The mixture is then presented to the image bearing surface to allow the triboelectrically charged toner particles to deposit in the regions of the surface where there is a preponderance of charge of the opposite polarity.

Development techniques which employ inductive means to charge the toner particles generally utilize a one-component developer of finely divided, dry, conductive toner particles. Such a technique is described in U.S. Pat. No. 3,909,258 to Kotz. In this case, the one-component developer of finely divided, electronically conductive toner particles are also magnetically attractable and are transported by a cylindrical support member that may be rotated and is spaced from the receptor. The toner particles are uniformly magnetically attracted toward the support member and are inductively charged via an electrically conductive path or "circuit" which includes the support member and the toner particles presented between the support member and the electrical potential pattern bearing surface of a receptor. A fixed direct current electrical potential or ground is generally connected in the circuit which with the potential pattern at the surface of the receptor establishes the electrical potential for producing the electronic current flow for inductively charging the toner particles. Deposition of the toner particles occurs in the image areas of the potential pattern bearing surface of the receptor when the magnitude of charge induced on the toner particles results in a transient electrical transfer force greater than and opposed to the magnetic force of attraction on the toner particles.

Development techniques which employ electrostatic means to charge the finely divided, dry toner particles generally utilize a one-component developer provided by toner particles of insulative material and rely on electrostatically generated ions sprayed on the toner particles to charge them. An apparatus for such a technique is described in U.S. Pat. No. 3,552,355 to Flint. In this case, a supply of one-component developer of magnetically attractable, electrically insulating toner particles is continuously moved around a transport roll and past a charging device whereupon ions that are electrostatically generated by means such as a corona are sprayed on the toner particles. The polarity of the electrostatically generated ions is generally opposite to that of the electrical potential pattern to be developed such that the charged toner particles will be preferentially deposited in these oppositely charged regions of the electrical potential pattern bearing surface. This apparatus also requires the presence of oscillating wave forming elements situated between the transport roll and the surface to be developed which functionally provides undulation of the toner particles in the development region.

While all of the above techniques have certain advantages in particular situations, each one suffers from disadvantages which impair their utility in actual machines.

In the conventional cascade development technique, the toner portion of the developer has a definite charge polarity that is not reversible without changing the toner portion and/or the carrier portion of the developer. Thus, positive and negative developed images cannot easily be made. Also, the developed images are hollow and solid areas are not filled in resulting in low fidelity development compared to the original charge pattern. The triboelectric properties of the toner, while necessary to development, cause severe problems. Uneven charging of the toner causes backgrounding and uneven forces between carrier and toner result in varying threshold levels for deposition from toner to toner. Also, since the toner retains its charge for long periods of time, some toner escapes the development region during cascading and enters other parts of the apparatus causing mechanical problems familiar to those skilled in the art. These problems, coupled with the inherent problems of using a two-component developer system where only one component is depleted, definitely limit the utility of such techniques.

Magnetic brush development, being a form of cascade development, suffers from some of the above-mentioned disadvantages although it overcomes others. It requires two-component type developers which have the concomitant problems mentioned above. Also, due to the extreme frictional forces created by the mechanical brushing action of this system, the carrier particles become contaminated more rapidly resulting in a degradation of their triboelectric properties and requiring the toner-carrier mixture to be periodically replaced. Furthermore, the triboelectric intraction of the toner particles with the surface of the receptor necessitates tailoring the triboelectric properties of the toner to both the carrier material and the specific receptor material, and consequently, generally requires a specially selected developer for each type of receptor material.

The technique described in U.S. Pat. No. 3,909,258 to Kotz using a one-component developer of relatively conductive and magnetically attractable toner particles avoids many of the disadvantages associated with the above-mentioned cascade type techniques. This technique is capable of producing excellent quality likenesses of a desired configuration on a recording medium. However, problems arise in situations where it is desirable to transfer the developed image from the receptor to another medium such as plain paper. Such image transfer is particularly difficult to accomplish and control by electrical or electrostatic transfer means because the conductive nature of the toner particles permits rapid charge interchange with paper surfaces causing the attractive transfer forces on conductive toner particles to be generally low and variable as a function of time. Even in situations where the electrical properties of the medium to which the image is to be transferred can be controlled, the transferred image will often be inferior to the developed image in that it will lack the image density and edge sharpness required for a commercially acceptable copy.

While the apparatus described in U.S. Pat. No. 3,552,355 to Flint is capable of high density toner particle deposition, there are inherent problems associated with controllably charging insulating toner particles with a corona or similar type ion generating device. Corona devices are subject to well-known problems such as contamination, especially by airborne toner particles, which will result in non-uniform ion emission along the length of the corona wires and, thus, make it difficult to control the amount of charge deposited on the toner particles. Lengthwise non-uniform ion emission is also a characteristic of negative corona sources and would present an additional problem when negatively charged toner particles are desired. Furthermore, continuous ion emission from the corona source coupled with the probability that individual toner particles will be moved past this source many times can result in a time dependent change in the charge density per toner particle. These and other corona associated problems would be apparent as streaks and time dependent density variations in the developed images and, consequently, would limit the usefulness of the process. The wave-forming elements required in the development region further complicates the apparatus and limits the degree to which the spacing between the transport roll and the photoreceptor can be reduced. At times, a small gap is desirable to obtain optimum performance from a particular development process.

SUMMARY OF THE INVENTION

In the present invention, the use of two-component developer, the use of one-component developer of electronically conductive toner particles, the use of ions sprayed on one-component type developer, the use of wave-forming elements in the development region when using one-component type developer, and reliance on triboelectric means to controllably charge the toner in two-component developer, or reliance on electrostatic means to controllably charge one-component developer toner particles are eliminated. It should be noted, moreover, that the present invention is applicable to the development of electrical potential patterns in general, regardless of whether provided by electrostatic charge as in conventional xerography or by some other equivalent means.

The present invention embodies the discovery of a novel means of controllably and efficiently charging one-component developer of magnetically attractable, electrically insulating toner particles resulting in a development technique, which simultaneously has most of the image development advantages associated with the previously described technique utilizing one-component developer of magnetically attractable, electronically conductive toner particles and the image transfer advantages associated with techniques utilizing a developer having insulating toner particles.

In accordance with the present invention, a process is provided for selectively depositing toner particles on one surface of a layer of material in accordance with an electrical potential pattern presented at said surface, the process comprising the steps of:

1. Providing an electrode-developer transport means positioned a short and relatively uniform distance from and in opposing relationship to said one surface of said layer of material, said electrode-developer transport means including at least one electrically conductive portion;

2. Providing electrical means between the surface of said layer of material opposite said one surface and said electrode-developer transport means for establishing a unidirectional electrical potential difference between said electrically conductive portion of said electrode-developer transport means and said one surface;

3. Providing a relatively uniform magnetic force of attraction in the region adjacent to said electrode-developer transport means;

4. Providing a physically continuous path of one-component developer of magnetically attractable, electrically insulating toner particles between said one surface and said electrically conductive portion with a rapid, turbulent physical mixing action imparted to said toner particles for bringing said toner particles into relatively rapid repetitive electrical contact with said electrically conductive portion and for providing random relative motion and rapid physical contact between said toner particles of produce an electrical charge on said particles of a polarity and of an amount sufficient to cause such charged toner particles to be attracted to said layer of material with a force sufficient to overcome the counterforce provided by said magnetic force of attraction whereby said charged toner is deposited on said one surface of said layer of material in accordance with the electrical potential pattern presented at said surface.

The process of this invention embodies the discovery that one-component developer of magnetically attractable toner particles, which are very insulating while stationary in a relatively high electric field, will, when brought into relatively rapid repetitive electrical contact with the conductive surface of an electric field producing member of such a relatively high electric field by means of rapid, turbulent, physical mixing of the toner particles, exhibit charge transport properties that are equivalent to toner having several orders of magnitude higher conductivity. This increase in the ability of insulating toner particles to transport charge is measurable and enables the toner particles to electrically acquire the charge density necessary to develop uniformly toned high contrast reproductions of an electrical potential pattern, such as is presented by an electrostatic charge pattern formed on a photoconductive recording medium or on a dielectric medium, independent of the polarity of the potential pattern. Toner charge is determined in response to the electric field the toner experiences at the conductive surface of the electric field producing member and is a direct result of the degree of physical mixing the toner experiences.

The required rapid turbulent physical mixing of the toner can, for example, be obtained when the toner particles are magnetically attracted to and controlled on a transport surface spaced a short and controlled distance from another surface at which an electrical potential pattern is present such that the toner particles form a physically continuous path between the two surfaces, such transport surface being provided by an electrode-developer transport means with such means also providing an electrically conductive portion contacting the toner. Rapid linear displacement of the transport surface bearing the toner particles will result in rapid turbulent physical mixing of the toner material in the region between the conductive portion of the electrode-developer transport means and the electrical potential pattern bearing surface.

Some of the details concerning the nature of the phenomena that are involved in connection with the charging of the one-component developer of insulating toner particles when practicing the process of this invention are not definitely known, and it is to be understood that the nature and scope of this invention is not to be regarded as dependent upon any theoretical considerations expressed herein. However, observations and measurements made form the basis for the following explanation, which, it is believed, will provide a better understanding of the invention presented herein. Electrical charge of a predetermined polarity is injected onto the toner particles when they are brought into contact repetitively with a conductive surface from which a high electric field emanates. Since the toner particles are insulating, the injected charge is bound on a site on the toner particles, that is, the injected charge cannot rapidly move either laterally along the surface or through the bulk of the toner particles. However, in the presence of an electric field, some electrical charge can be transferred or re-injected from one toner particle to another when a charge containing site on one particle contacts a site on the other toner. Therefore, electrical charge is transported and distributed throughout the toner particles in the high electric field region in proportion to the degree of the physical mixing action experienced by the toner particles.

BRIEF DESCRIPTION OF THE DRAWING

For a more complete understanding of the invention, reference should be made to the accompanying drawing, wherein like or like functioning elements in each of the several figures are identified by the same reference characters, and wherein.

DETAILED DESCRIPTION

Figure 1:
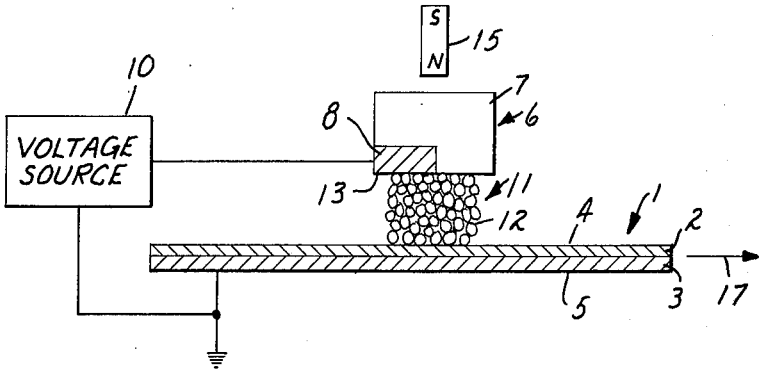
FIG. 1 is a schematic cross-sectional view depicting the basic elements required for carrying out a process using this invention.

Referring to FIG. 1 (not drawn to scale), a receptor member 1 is shown comprising a layer 2 of insulating or photoconductive material having a surface 4 at which an electrical potential pattern to be developed is provided and a layer 3 in physical contact with layer 2 which acts as a backing for layer 2 and may or may not be comprised of the same material as layer 2. The surface 5 of member 1 opposite surface 4 is coupled to ground either by a direct electronically conductive path between layer 3 and ground or by a virtual ground or by capacitive coupling between layer 3 and ground. Layer 3 may or may not be conductive.

An electrode-developer transport means 6 is placed in a spaced opposing relationship to the surface 4 of the receptor member 1. The electrode-developer transport means 6 includes at least one portion 8 that is electrically conductive and may have another portion 7 which is formed from either conductive or insulating materials or a mixture thereof. Electrically conductive as used with reference to portion 8 means a material whose electronic properties are sufficient such that at an interface between the surface portion 8 and toner particles in the presence of the electric field of this process a substantial amount of electrical charge is injected from one material to the other. The portions 7 and 8 may or may not be in electrical or physical contact. For purposes of clarity, portions 7 and 8 are shown in FIG. 1 as being in contact. Electrical means are provided for coupling the conductive portion 8 with the surface 5 of the receptor 1. In the case of FIG. 1, the electrically conductive portion 8 of electrode-developer transport means 6 is electrically connected to a voltage source 10 which is referenced or electrically connected to ground. The region between electrode-developer transport means 6 and the surface 4 of receptor member 1 defines a development region 11. A one-component developer 12 of magnetically attractable, electrically insulating toner particles is distributed in the development region 11. Portion 7 and/or 8 of the electrode-developer transport means 6 may function as a mechanical transport support member for the toner particles 12 in region 11. The toner particles 12 are distributed in the region 11 such that the individual toner particles join together to form a physically continuous path between the receptor member 1 and electrode-developer transport means 6. A portion of the toner particles 12 are in electrical contact with surface 13 of the electrically conductive portion 8. The toner particles 12 are held and controlled in the development region 11 by means of a relatively uniform magnetic force provided by a source of magnetic attraction 15. A relatively turbulent and rapid physical mixing of the toner particles 12 in the development region 11 is provided as well as relative motion between the surface 13 of the conductive portion 8 of the electrode-developer transport means 6 and the toner particles in contact with the surface 13. The rapid and turbulent mixing of the toner particles causes repetitive electrical contact of the toner particles with the surface 13. The mixing may, for example, be provided by motion of all or any portion of the electrode-developer transport means 6, or by motion of the source of magnetic attraction 15 in combination with motion of all or any portion of the electrode-developer transport means 6.

In the operation of this invention, referring to FIG. 1, development of a potential pattern provided at the surface 4 of receptor member 1 is accomplished in the following manner. The magnitude and polarity of the electrical potential pattern present at the surface of 4 of receptor member 1 and the magnitude and polarity of any voltage provided by the voltage source 10 define image and non-image areas at the surface 4 of member 1. The image areas being those areas at the surface 4 with an electrical potential with respect to the conductive portion 8 of electrode-developer transport means 6 of a polarity and magnitude which are to be developed with toner. The non-image areas are those with an electrical potential and polarity with respect to the conductive portion 8 of electrode-developer transport means 6 which are to be left relatively free of toner. The presence on the surface 4 of electrical potentials together with any electrical potential that may be provided by the voltage source 10 gives rise to electric fields acting on the toner particles 12 in the development region 11 and, in particular, acting on the toner particles contacting the surface 13 of the conductive portion 8 of the electrode-developer transport means 6. The electric fields cause electric charge to be injected from the electrically conductive surface 13 onto the toner particles contacting the surface 13.

The amount and polarity of said electric charge is determined and controlled by the voltage provided by the voltage source 10, the voltages on the surface 4, the geometry of the development region, and the amount of said relative motion between surface 13 and the toner particles 12. The rapid and relatively turbulent physical mixing action imparted to the toner particles 12 cause the toner particles 12, which have been contacting the surface 13, to be transported towards the surface 4. In addition, the charge on toner particles can be transferred to other toner particles in the physically continuous path by reinjection from one insulating toner particle to another as a result of the physical mixing action. The electrically charged, magnetically attractable toner particles adjacent to or near surface 4 are influenced by a magnetic counterforce of a magnitude determined by the source of magnetic attraction 15 and in a direction having a major component away from the surface 4 (upward in FIG. 1). This relatively uniform magnetic counterforce is in opposition to the electric force on toner particles adjacent the surface 4 resulting from the amount and polarity of electric charge on such toner particles and the electric field acting on such toner particles as a result of the electrical potentials on surface 4 and any electrical potential provided by voltage source 10. The aforementioned image areas are those areas of surface 4 where the said electric force of attraction to surface 4 of such toner particles is greater than the said magnetic counterforce and the aforementioned non-image areas are those areas of surface 4 where the magnetic counterforce is greater than the electric force of attraction.

As a result of the combination of these forces in the said image and non-image areas, toner particles will not be attracted and not adhere to the non-image areas. In this way, toner particles are deposited preferentially in image areas over the whole of surface 4 by continuously moving the electrical potential pattern bearing receptor member 1 in the direction indicated by arrow 17 or in the opposite direction, thereby developing the said potential pattern on member 1 with toner particles 12.

In the above manner, high density, high contrast, low background and high quality of detail images are obtained, such images being high fidelity reproductions of the potential pattern to be reproduced. The developed images may then be fixed directly onto the potential pattern bearing member 1 or transferred to other materials by well-known conventional means described in the art of electrographics and electro-photography.

Figure 2:
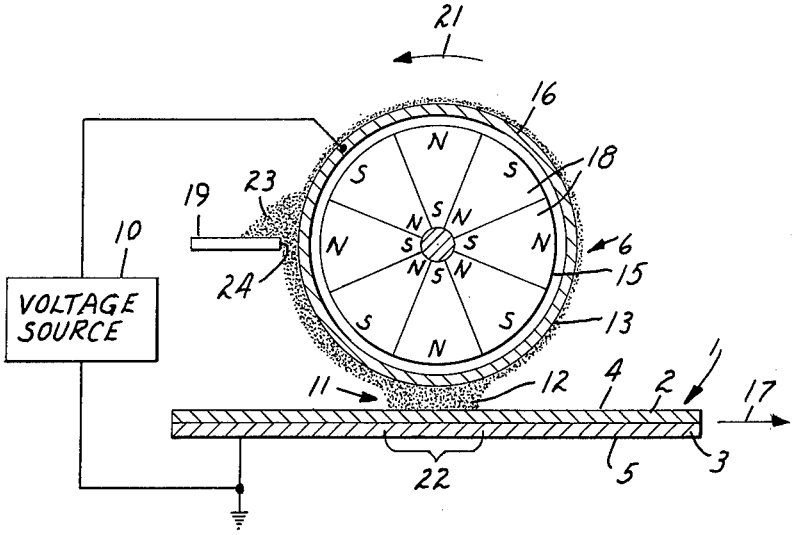
FIG. 2 is a schematic cross-sectional view of a first embodiment of an apparatus for carrying out a process using this invention.

A first embodiment of the invention presented herein is shown in FIG. 2. Referring to FIG. 2 (not drawn to scale), the source of magnetic attraction 15 comprises a cylindrical magnetically permeable shaft 20 on which a plurality of axially extending sector-shaped magnetic sections 18 are mounted. An even number of magnetic sections 18 is preferred. The number of magnetic sectors is chosen as 8 in this embodiment for purposes of illustration. In practice, the number may be more or less than this. Sections 18 are magnetized to provide a relatively uniform magnetic field along their axial length and are polarized to have a different magnetic pole on the outer surface than on the inner surface with the adjacent sectors 18 presenting opposite poles at their outer surface as shown by the N and S designations in FIG. 2. The electrode-developer transport means 6 is in the form of an electrically conductive hollow circular cylindrical shell 16 which surrounds and extends axially relative to the source of magnetic attraction 15. Shell 16 is rotatably mounted relative to shaft 20, as by bearing mounted end caps (not shown) carried on shaft 20 and secured to shell 16. The outer surface 13 of shell 16 corresponds to the electrically conductive surface 13 of the electrode-developer transport means 6 of FIG. 1.

A rectangular prismatic element 19, which is comprised of insulating or electrically conductive material, provides an edge surface 24 extending the axial length of shell 16. Element 19 is positioned so that the surface 24 is at a fixed distance from the outer surface 13 of shell 16 and parallel to the axis of shell 16. The fixed distance the surface 24 of element 19 is spaced from the shell 16 is hereinafter referred to as the doctor gap. The element 19 functions to uniformly and smoothly meter the one-component developer of magnetically attractable electrically insulating toner particles 12 onto the shell 16 of the electrode-developer transport means 6 as the shell 16 rotates in the direction indicated by arrow 21 (counter-clockwise in FIG. 2). The amount of toner particles 12 transported about the shell 16 is predetermined and controlled by adjustment of the doctor gap and by the relative axial position of element 19 with respect to the source of magnetic attraction 15. In practice, element 19 can take a variety of shapes and sizes to provide the above-mentioned functions. Excess toner particles 12 accumulate in region 23 and a supply means, not shown, is provided for maintaining a continuous supply of toner particles 12 in region 23 above the doctor gap.

As in FIG. 1, potential pattern bearing receptor member 1 comprises the layer 2 of insulating or photoconductive material, which provides the surface 4 at which the potential pattern to be developed is presented and a second layer 3, which acts as a backing for layer 2. In this embodiment, layer 3 is electrically conducting. The receptor member 1 and the shell 16 are positioned so the shell, in the axial direction, is at a fixed and uniform distance from the surface 4 of member 1. This spacing or distance is hereinafter referred to as the development gap. The potential pattern bearing receptor member 1 may be rigid or flexible, and may be supported on or comprise the outer surface of an additional member, such as a cylindrical drum or belt (not shown). As in FIG. 1, the surface 5 of potential pattern bearing receptor member 1 opposite surface 4 is electrically coupled to ground. Such coupling can take on any of the forms as described in connection with FIG. 1.

The shell 16 for the electrode-developer transport means 6 is electrically connected to a voltage source 10, which is also electrically connected to ground. The connection of source 10 is only schematically shown, since the shell 16 is rotatable. Arrangements for providing an electrical connection to a rotating member are well known in the art.

In the operation of this embodiment in FIG. 2 in accordance with the process of this invention, the magnetic sections 18 of source 15 are stationary with one of the sections 18 positioned generally opposite the surface 4. The doctor gap and development gap are chosen, such that in conjunction with the rate of rotation of shell 16 about its axis, the toner particles in the development region 11 contact surface 4 over a region 22 which is relatively constant in time, uniform along the axis of the shell 16 and of a magnitude to obtain the desired development speed and density. Relatively turbulent and rapid physical mixing action on toner particles 12 in region 11 is accomplished by means of relatively rapid rotation of the shell 16 about its axis wherein the degree of mixing action increases with increases in the speed of rotation. As a result of the rotation, wherein a portion of the toner particles 12 repeatedly contact the outer surface 13 of electrically conductive shell 16 of the electrode-developer transport means 6, such toner particles become electrically charged by injection of electric charge from the surface 13 as previously described. The physical mixing action causes electrical charge to be transported to other toner particles by means of physical transport of toner particles from the position adjacent the surface 13 to the portion adjacent the surface 4 and by reinjection of electrical charge between toner particles as previously described. The development of the said potential pattern on receptor member 1 proceeds as it is moved continuously, relative to the electrode-developer transport means 6, in the direction shown by arrow 17 or in the opposite direction. The amount of toner particles deposited and where they are deposited on surface 4 is determined by the above conditions and the magnitude and polarity of electrical potential provided by the voltage source 10 relative to the magnitude and polarity of the electrical potential pattern presented at surface 4.

It is also possible to operate the apparatus of FIG. 2 with the source of magnetic attraction 15 rotating. The rotation of source 15 must be high enough to prevent the appearance of "bands" in the developed image. The "bands" appear when the alternate presentation of North and South poles of the magnet sections 18 at the region 22 is carried out too slowly. It has been found that the rapid rotation of the source 15 provides better flow of the toner particles through the development gap. The speed of rotation of shell 16 can be reduced slightly when the source 15 is rotated. The source 15 can be rotated either in the same direction as shell 16, at the same or different speeds, or rotated opposite to shell 16.

In this manner, excellent quality developments of the potential pattern on receptor member 1 are reproducibly obtained. The developed images are of high density, low background, high edge sharpness with good rendition of both fine detail and large solid areas.

Figure 3:
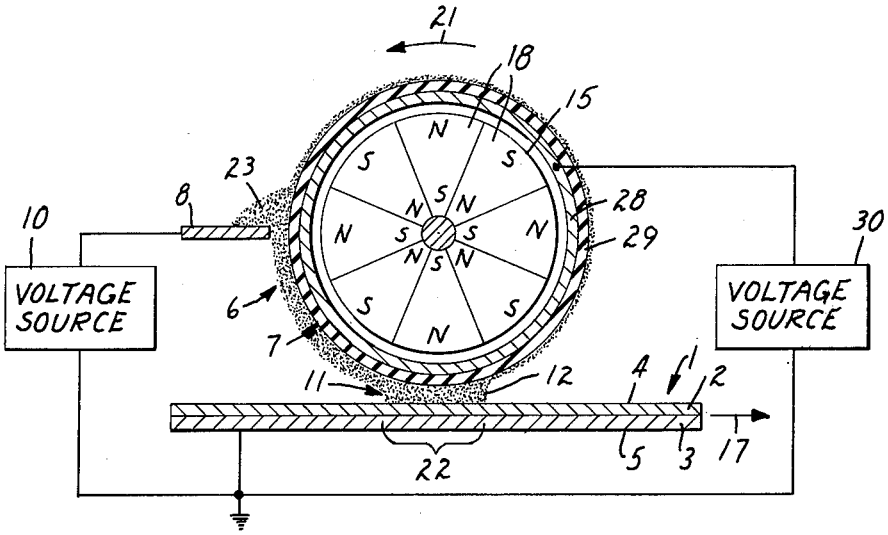
FIG. 3 is a schematic cross-sectional view of a second embodiment of an apparatus for carrying out a process using this invention.

A second embodiment of this invention is shown in FIG. 3. A receptor member 1 is used which is the same as that described in connection with FIG. 2. Referring to FIG. 3 (not drawn to scale), the electrode-developer transport means 6 is comprised of two physically separated portions 7 and 8. Portion 8 comprises a rectangular prismatic electrically conductive element which, in addition to providing one electronically conductive portion of electrode-developer transport means 6, carries out the functions described for element 19 in FIG. 2. Portion 8 is electrically coupled to a voltage source 10, which is also coupled to ground. The other portion 7 of electrode-developer transport means 6 includes an electrically conductive hollow circular cylindrical shell 28 on the outer surface of which a layer 29 of electrically insulating material is carried. In this embodiment, layer 29 comprises electrically insulating material which acts as a mechanical support for transporting the toner particles 12. The shell 28 provides an electrically conductive portion which is connected to a second voltage source 30 which is also connected to ground. The shell 28 and the electrically conductive portion 8 together with the voltage sources 10 and 30 plus the potential pattern at surface 4 act to control and determine the electric fields acting on the toner particles 12. An electric field to which the toner particles 12 are presented is established between the portion 8 and the layer 29. In addition, an electric field to which the toner particles are presented is established between the layer 28 and the surface 4 as well as between the portion 8 and the surface 4.

In the operation of this invention, according to this embodiment, the voltages provided by voltage sources 10 and 30 are determined in combination with the potential pattern on surface 4 of member 1 to provide the desired density and rate of development. In general, in this embodiment, the voltages provided by both source 10 and 30 control and determine the polarity and amount of electric charge injection from portion 8 onto the electrically insulating toner particles 12 while the voltage provided by source 30, in conjunction with the potential pattern on surface 4, controls and determines the amount of toner particles deposited on image and non-image regions of surface 4 of distinct magnitude and polarity of potential. In this embodiment, the physical turbulent mixing of the toner particles 12 acts to transport electric charge from the toner particles in the region adjacent portion 8 to the toner particles in the region 22 at surface 4. In this case, the physically continuous path provided by the toner particles 12 extends from the conductive portion 8 to the region 22 of surface 4.

As in the first embodiment, the apparatus shown in FIG. 3 includes the source of magnetic attraction 15 as described in connection with FIG. 2, which can be stationary or rotated in the same direction as shell 28 at the same or different speeds or rotated opposite to shell 28.

Development of the potential pattern on surface 4 of member 1 proceeds as described in the previous embodiment by movement of receptor member 1 relative to the development region 11 in the direction indicated by arrow 17 or in the opposite direction. Rotation of the shell 28 is counter-clockwise as indicated by the arrow 21. High density, low background, high edge sharpness images are obtained which have good rendition of both fine detail and large solid areas.

Figure 4:
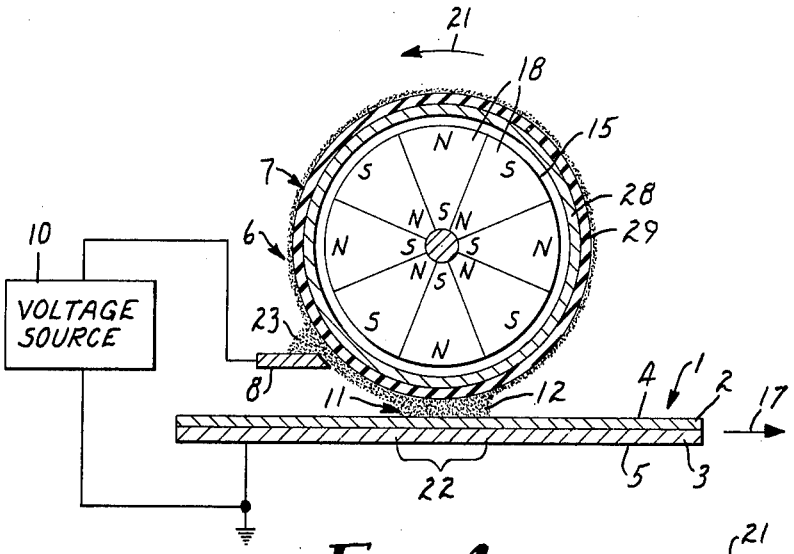
FIG. 4 is a schematic cross-sectional view of a third embodiment of an apparatus for carrying out a process using this invention.

Referring to FIG. 4, another embodiment is shown and is like the embodiment of FIG. 3 except that the second voltage source 30 is not used and the portion 8 is preferably positioned relatively close to the portion of the toner particles contacting surface 4. With no voltage source applied to shell 28, shell 28 can be of insulating material making it possible to eliminate the layer 29, if desired. The portion 8 provides a limited conductive surface area in contact with the toner particles 12 making its position important to the quality of the developed image and requires that attention be given to its shape so that an adequate portion of its conductive surface is contacted by the toner particles 12. Development proceeds as in the previous embodiments by movement of receptor member 1 relative to the development region 11 and in the direction indicated by arrow 17 or in the opposite direction.

Figure 5:
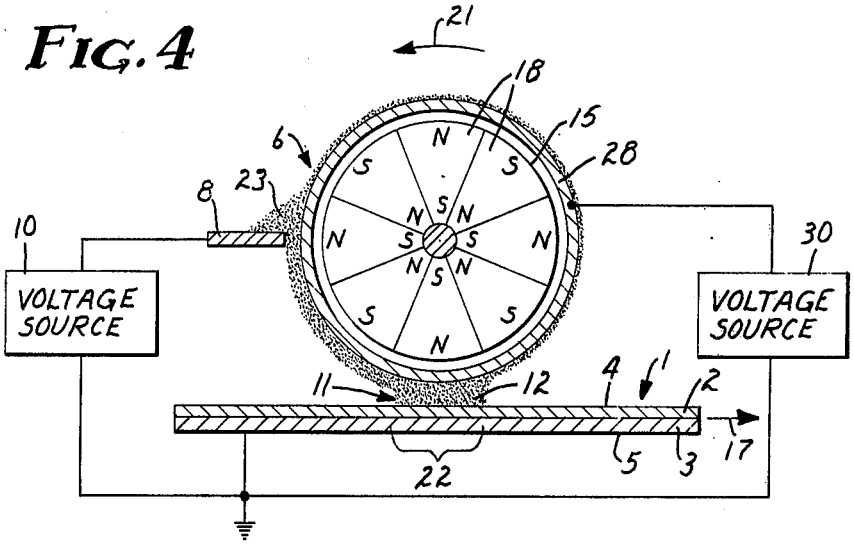
FIG. 5 is a schematic cross-sectional view of a fourth embodiment of an apparatus for carrying out a process using this invention.

Another embodiment of the invention is shown in FIG. 5 and is like the embodiment of FIG. 3 except that layer 29 is not used so the electrically conducting material of shell 28 provides another electrically conductive portion of the electrode-developer transport means 6 with the electrically conductive portion 8. In this case, the toner particles 12 contact portion 8 and the surface of shell 28 and under the influence of voltages provided by sources 10 and 30 electric charge is injected onto the toner particles 12 contacting the surface 13 and the surface of shell 28. In this particular embodiment, of the two voltages, the voltage provided by source 30 is the most critical for determining the amount of toner particles that is deposited on member 1 in the operation of this invention according to this embodiment. The degree to which the voltage provided by source 10 is effective in influencing the development of the potential pattern on surface 4 is in general related to and proportional to the magnitude of the algebraic difference between the voltages provided by sources 10 and 30. As in the previous embodiments, development proceeds by motion of member 1 relative to the development region 11 and in the direction indicated by arrow 17 or in the opposite direction.

In all of the above embodiments of this invention, the voltages, gaps, spacings, and rates of rotation must be adjusted by reproducibly obtain high quality developments.

The techniques described in the above embodiments have been necessarily specific for purposes of clarity and illustration. Extensions, alterations and modifications of the above-described embodiments of this invention will be obvious to those skilled in the art.

Since the process of this invention is dependent on electrical charging and charge transport of and by one-component developer of electrically insulating toner particles as a result of rapid, turbulent, physical mixing action on the toner particles in the development region, reference is made to FIGS. 6 through 10 which serve to provide a better understanding of the operating principles and mechanism of this invention and establish limits on the types of toner particles to which this invention is applicable.

Figure 6:
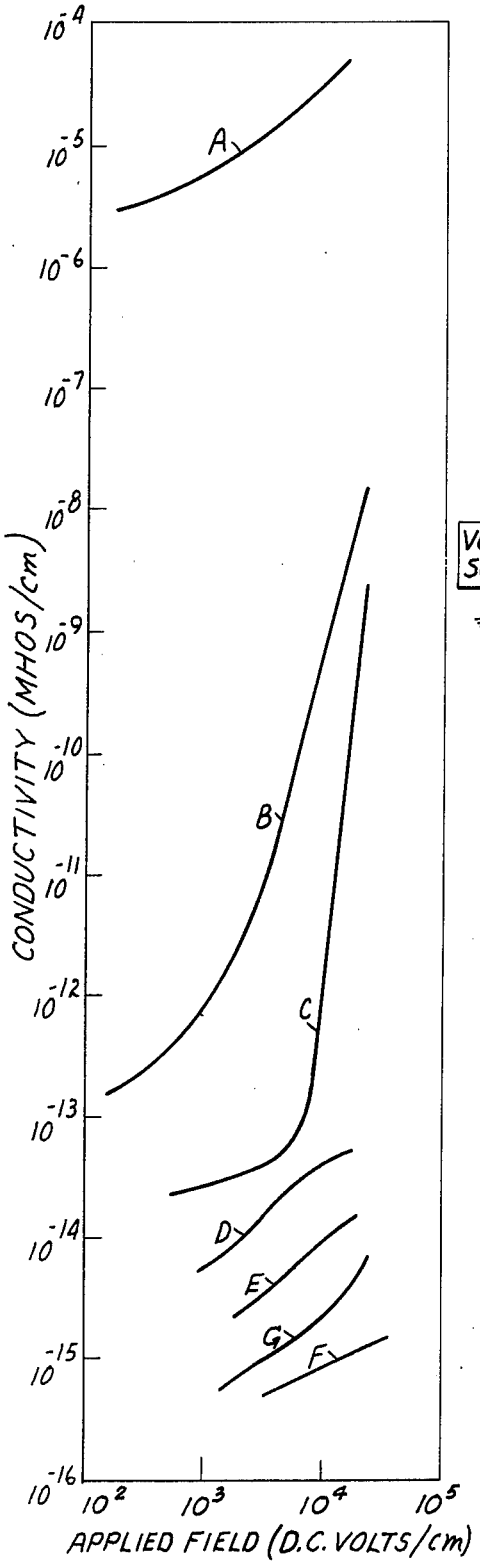
FIG. 6 is a graph of a plot of static electrical conductivity vs d.c. applied electric field for several types of toner particles.

FIG. 6 is a graph showing a log-log plot of the static electrical conductivity as a function of d.c. applied electric field for various representative types of toners. The static electrical conductivity measurements were made according to the technique described at column 3, line 54 through column 4, line 47 of U.S. Pat. No. 3,639,245 to Nelson. Each curve, labeled A through G, represents a particular type of toner, the characteristics of which are summarized in Table I.

The toners A, D, E, and F of FIG. 6 and Table I are all one-component developers of magnetically attractable toner particles processed according to the teachings of U.S. Pat. No. 3,639,245 to Nelson. Each has a 60 percent by weight magnetic iron oxide concentration in an Epon resin base. However, toner A, which is considered, for purposes of this invention, to be relatively conductive, has 2.0 percent by weight conductive carbon particles embedded in the surface layer of the particles and toners D, E, and F, which are all considered to be electrically insulating, have 0.60, 0.00, and 0.33 percent by weight, respectively, of conductive carbon particles embedded in the surface layer of the particles. Toner A is a sample of Type 355 imaging powder commercially sold by Minnesota Mining and Manufacturing Company, Saint Paul, Minn., for use in its Model VQC I copying machine.

Toner B of FIG. 6 and Table I is a one-component developer of magnetically attractable toner particles that is considered to be electrically conductive for purposes of this invention. Toner B is processed similarly to the teachings of U.S. Pat. No. 3,639,245 to Nelson with the exception that approximately 5.0 percent by weight conductive carbon particles are uniformly dispersed on the surface of the toner particles and also throughout the resin containing volume of the toner particles.

Toner C of FIG. 6 and Table I is a one-component developer of magnetically attractable toner particles and is considered to be electrically insulating for purposes of this invention. Toner C is also processed similar to the teachings of U.S. Pat. No. 3,639,245 to Nelson with the exception that it has 4.0 percent by weight conductive carbon particles uniformly dispersed on the surface of the particles and also throughout the resin containing volume of the toner particles.

Toner G of FIG. 6 and Table I is the non-magnetic, insulating toner component of the two-component developer used in the Model 3100 copying machine manufactured by the Xerox Corporation. The static electrical conductivity of this toner is presented to provide a reference for the limits of the static electrical conductivity of the one-component developer of electrically insulating, magnetically attractable toner particles to which this invention applies although this reference toner is non-magnetically attractable and, therefore, is not suitable for the process described herein.

Utilizing the above static conductivity measurement technique, it has been found that one-component developer of magnetically attractable, electrically insulating toner particles which are suitable in the operation of this invention generally are those toners which have a static conductivity less than about $10^{-12}$ mhos per centimeter at an electric field of 10,000 d.c. volts per centimeter. Because of their insulating properties and their magnetic attractability, the toners labeled C, D, E, and F in FIG. 6 and Table I are suitable for use in the process described in this invention. This group of suitable toners is only representative and does not include all possible toners that are suitable for this invention.

TABLE I

| TYPE OF TONER | PARTS BY WEIGHT Pigment[1] | Resin[2] | Carbon[3] Black | SIZE DISTRIBUTION 95%> | 50%> | 5%> | STATIC CONDUCTIVITY (MHOS/CM.) 10,000 v/cm. |
|---|---|---|---|---|---|---|---|
| A | 60 | 40 | 2.0 | 5 | 13 | 25 | $3.4 \times 10^{-5}$ |
| B | 50 | 50 | 5.0 | 8 | 16 | 29 | $5.8 \times 10^{-10}$ |
| C | 50 | 50 | 4.0 | 8 | 13 | 22 | $9.0 \times 10^{-13}$ |
| D | 60 | 40 | 0.60 | 7 | 15 | 26 | $3.8 \times 10^{-14}$ |
| E | 60 | 40 | 0.0 | 5 | 14 | 24 | $1.1 \times 10^{-14}$ |
| F | 60 | 40 | 0.33 | 7 | 14 | 22 | $8.5 \times 10^{-16}$ |
| G | 0 | 100 | Trace | 5 | 10 | 18 | $2.1 \times 10^{-15}$ |

[1]Pigments used are as follows: A, B, C, D, E, F - Magnetic Iron Oxide (0.2 to 0.8 micron diameter).
[2]All examples except G used Bisphenol-A- solid epoxy resin sold under the tradename Epon by the Shell Chemical Company. G is believed to be a polyester resin.
[3]All examples except G used conductive carbon particles approximately 30 millimicrons in diameteras measured by electron microscope.
[4]The size distribution data are percent by number greater than the indicated sizes which are in microns.

Figure 7:
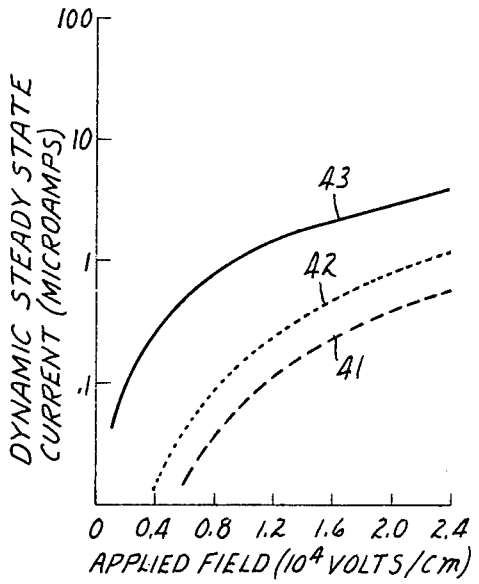
FIG. 7 is a graph of a plot of dynamic steady state current as a function of d.c. applied electric field for three different developer transport surface speeds when transporting a one-component developer of insulating, magnetically attractable toner particles through the electric field.
Figure 8:
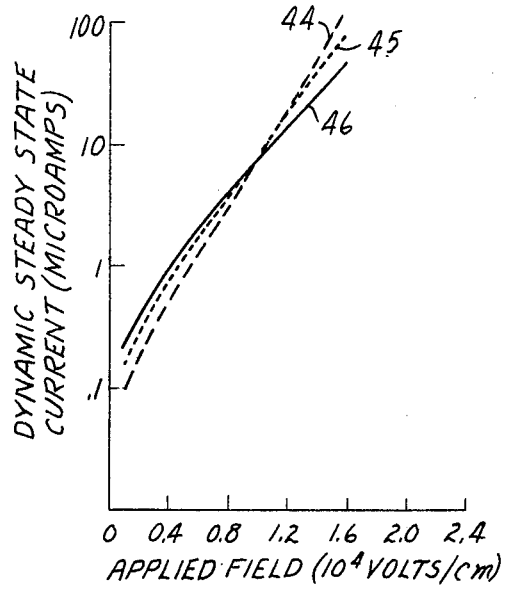
FIG. 8 is a graph of a plot of dynamic steady state current as a function of d.c. applied electric field for three different developer transport surface speeds when transporting a one-component developer of relatively conductive, magnetically attractable toner particles through the electric field.

Referring to FIGS. 7 and 8, there is presented a graph of the dynamic or motion dependent charge transport characteristics of toner particles B and C from Table I as a function of applied d.c. electric field. These measurements were made using a developer apparatus similar to that depicted in FIG. 2, except that an electrically conductive aluminum member was used in place of the potential pattern bearing member 1 of FIG. 2 and the element 19 was of aluminum with the shell 16 and element 19 connected via a switch (not shown) to a voltage source 10 which was a variable d.c. source. Referring to FIG. 2, a stainless steel circular cylindrical shell 16 rotating about its axis in a counter-clockwise direction as shown was used as the electrode means 6. The shell 16 had an outside diameter of about 3.18 centimeters and a length of about 24 centimeters. The source of magnetic attraction 15 was stationary and had a diameter of about 2.84 centimeters. It provided a maximum radial magnetic field of about 800 guass. The minimum spacing between edge surface 24 of blade 19 and the shell, i.e., the doctor gap, was a uniform 0.030 centimeter while the minimum spacing between the shell 16 and the surface 4 of the aluminum member 1 was uniform and about 0.051 centimeter. Toner particles 12 were present on the shell 16 such that a reservoir of excess toner particles 23 existed behind blade 19. A toner contact region 22 approximately 0.6 centimeter wide by 20 centimeters long was provided by this structure. To measure the dynamic steady state current for a particular toner, the electrically conductive aluminum member 1 was held stationary and electrically connected to ground through a 10,000 ohm resistor (not shown).

In operation, the toner particles to be measured were loaded on the shell 16 and the shell was rotated in a counter-clockwise direction to provide a predetermined linear surface speed to the surface of the shell. The switch was closed, which immediately biased the shell 16 and blade 19 at an electrical potential with respect to ground. An oscilloscope was used to monitor the potential across the 10,000 ohm resistor. The average steady state voltage drop across the resistor was recorded and the dynamic steady state current was then calculated by dividing the average steady state voltage drop by the value of the resistor for each value of bias potential and shell speed selected. The approximate applied electric field was calculated by dividing the bias potential by the minimum development gap spacing of 0.051 centimeter. It was observed that all one-component developers of magnetically attractable toner particles tested exhibit a monotonically increasing dynamic steady state current as a function of increasing applied electric field.

In the above manner, the dynamic steady state current can be measured as a function of both the applied electric field and the shell surface speed for any particular toner desired.

FIG. 7 is a graph of a semi-log plot of the dynamic steady state current as a function of d.c. applied electric field for three different shell surface speeds when using toner C of Table I. This toner is considered insulating and suitable for the practice of this invention. Curve 41 of FIG. 7 (the dashed line) represents current measured at a constant shell linear surface speed of 5 cm./sec., curve 42 of FIG. 7 (the dotted line) represents current measured at a constant shell linear surface speed of 10 cm./sec., and curve 43 of FIG. 7 (the solid line) represents current measured at a constant shell linear surface speed of 50 cm./sec. As shown by these curves, the magnitude of the dynamic steady state current increases at least ten times as the shell surface speed is increased from 5 cm./sec. to 50 cm./sec. for a constant applied electric field greater than about 10,000 volts/cm.

FIG. 8 is a graph of a semi-log plot of the dynamic steady state current as a function of d.c. applied electric field for three different shell surface speeds when using toner B of Table I. This toner is considered relatively conductive and not applicable to the practice of this invention. Curve 44 of FIG. 6 (the dashed line) represents current measured at a constant shell linear surface speed of 5 cm./sec., curve 45 of FIG. 8 (the dotted line) represents current measured at a constant shell linear surface speed of 10 cm./sec., and curve 46 of FIG. 8 (the solid line) represents current measured at a constant shell linear surface speed of 50 cm./sec. In contrast to the results of FIG. 7, the magnitude of the dynamic steady state current is about the same or decreases slightly as the shell surface speed is increased from 5 cm./sec. to 50 cm./sec. for a constant applied electric field greater than 10,000 volts/cm. In other words, the shell speed and, therefore, toner particle motion, has relatively little effect on the charge transport characteristics of this particular toner.

It was observed that the magnitude of the currents obtained with the so-called insulating toner particles is surprisingly high when sufficient physical mixing action is present and about the same order of magnitude as the currents obtained in the case of the so-called conductive toner particles.

Figure 9:
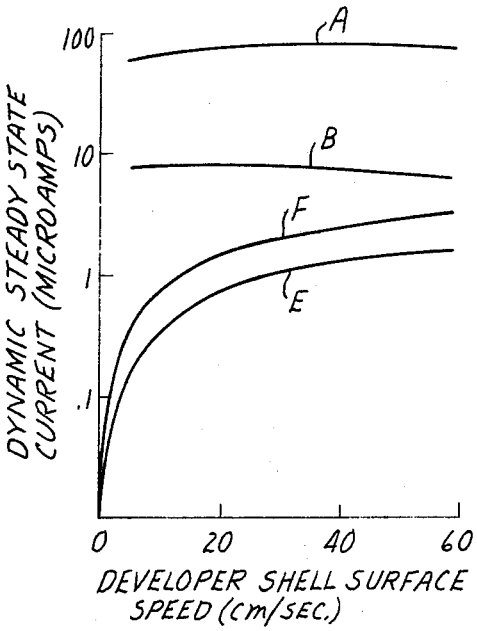
FIG. 9 is a graph of a plot of dynamic steady state current as a function of developer transport surface speed for several types of toners and applied electric fields.

Referring to FIG. 9, there is presented a graph of a semi-log plot of the dynamic steady state current as a function of shell surface speed for several types of toner particles and applied electric fields. Curve A of FIG. 9 represents data taken using toner A of Table I and a constant applied electric field of about $0.5 \times 10^4$ volts per centimeter. Curve B of FIG. 9 represents data taken using toner B of Table I and a constant applied electric field of about $1.0 \times 10^4$ volts per centimeter. Curves F and E of FIG. 9 represent data taken using toners F and E, respectively, of Table I and a constant applied electric field of about $2.0 \times 10^4$ volts per centimeter. Note that toners A and B, each considered relatively conductive and not applicable to the practice of this invention, have little or no motion dependence of charge transport characteristics whereas toners F and E, each considered to be insulating and suitable for purposes of this invention, have significant motion dependence of charge transport characteristics in that the dynamic steady state current increases approximately two orders of magnitude as the shell surface speed increases from 2 to 60 cm./sec. Curves E and F of FIG. 9 are representative of the behavior of one-component developers of magnetically attractable, electrically insulating toner particles which have a static electrical conductivity of less than about $10^{-12}$ mhos/cm. at an applied field of about 10,000 d.c. volts/cm. and are applicable in the practice of this invention.

The data of FIG. 9 shows a significant monotonically increasing motion dependent transport of charge with one-component developers of insulating, magnetically attractable toner particles and also shows that the currents associated with toner particle motion can be of relatively large magnitude to provide relatively high charge density on the toner particles during development. The data also shows the importance of controlled shell rotation to produce the rapid, turbulent, physical mixing of the toner particles which produces the charge transport necessary for development of potential patterns according to this invention.

Figure 10:
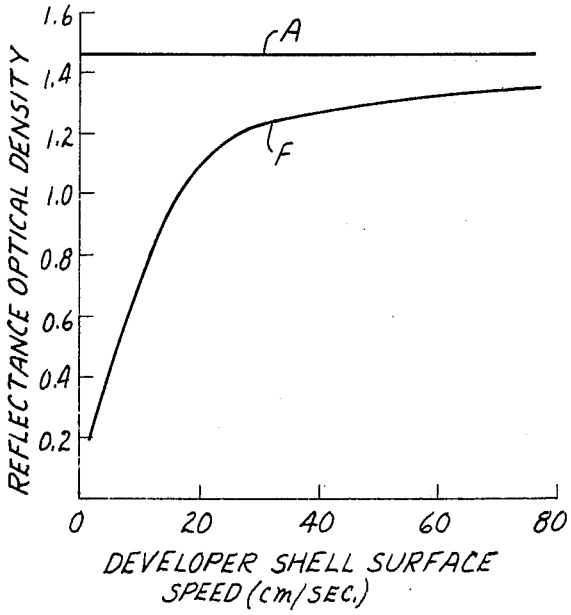
FIG. 10 is a graph of a plot of the diffuse reflection density of a developed solid area as a function of developer transport surface speed for one-component developer of insulating, magnetically attractable toner particles and for a one-component developer of relatively conductive, magnetically attractable toner particles.

FIG. 10 is presented to illustrate the relationship between the measurement of charge transport characteristics, i.e., dynamic steady state current, and development performance in the practice of this invention. FIG. 10 is a graph of a plot of the diffuse reflection optical density of a developed solid image area obtained as a function of shell surface speed when using a one-component developer of electrically insulating, magnetically attractable toner particles (toner F of Table I), and when using a one-component developer of relatively conductive, magnetically attractable toner particles (toner A of Table I). Dielectric polyester layers having a thickness of $2.5 \times 10^{-3}$ centimeters were uniformly charged to provide a surface potential of about +2000 volts and then developed using the two types of toner particles and shell linear surface speed as variables. The deposited toner particles were carefully heat fixed to the polyester surfaces and diffuse reflectance density of the developed image was subsequently measured and tabulated according to the toner particles used and the shell linear surface speed. A tabulation of this data is presented in Table II and an explanation of how the data was taken is presented in Examples 1 and 2 which follow. Referring to FIG. 10, the reflectance optical density obtained using toner A shows relatively no motion dependence and the shape of the curve correlates with curve A of FIG. 9. Also, note that the reflectance optical density obtained using toner F shows a significant motion dependence and the shape of this curve correlates qualitatively very closely to that of curve F of FIG. 9. The data of FIG. 10 illustrates the fact that the electrical charge transport, as measured by the dynamic steady state current, is proportional to and correlates with the development performance of one-component developers of insulating, magnetically attractable toner particles used in the process presented herein.

The data and results presented to this point have been necessarily specific to establish the operating principles and scope of this invention. A specific electrode means and source of physical mixing action has been used and shown to be a surprisingly effective means of charging one-component developers of electrically insulating, magnetically attractable toner particles whereas relatively little, if any, significant motion dependent charging has been observed with one-component developers of relatively electrically conductive toner particles. The ability to efficiently and controllably develop such insulating toner particles is especially significant when attempting to transfer the developed images to another medium, such as paper, by electrostatic means. The electrically insulating toner particles retain their electrical charge so that electrostatic transfer forces, acting on that charge, are substantially greater than in the case when relatively electrically conductive toner particles are used.

Hereinafter, the term dynamic steady state electric current refers to the current measured as described above in reference to FIGS. 7 through 9 or the current measured in apparatus similar to that employed in the above apparatus description.

In the process of this invention, one of the principle features is the manner in which electric charge is acquired by the electrically insulating toner particles. This process, referred to herein as charge injection, is to be distinguished and differentiated from various other means of charging toner particles. Three examples of such other means are: (1) the charging of relatively electrically conducting toner particles by induction, (2) triboelectric charging of electrically insulating toner particles, and (3) the spraying, in gaseous form, of electrically charged ions directly onto electrically insulating toner particles. In the case of induction, the toner particles are conductive and the charge on the particles is alterable in the presence of relatively low electric fields, i.e., less than about $10^3$ volts/cm. The electric charge, while on a particle, is not fixed or bound to a particular site. In the triboelectric case, the magnitude and polarity of the charge on the toner particles is determined and created as a result of the triboelectric properties of the particles and the materials which contact the particles. In the third mentioned means, the electric charge is deposited on insulating toner particles by a corona or other such similar device well known in the art. The difficulties of control of coronas, etc., are well known. The charging means, in the case of coronas, etc., may be said to be connected to the toner particles through a very high effective impedance, thus giving rise to relatively uncontrolled and inefficient charging of the toner.

In the present process, the charge acquired by the one-component developer of electrically insulating, magnetically attractable toner particles is bound onto sites on the particles and its polarity and magnitude are determined, for purposes of this invention, by a relatively low impedance connection between the toner particles and an electrically conductive portion of an electrode-developer transport means in the presence of an electric field and a relatively turbulent, rapid, physical mixing of the toner particles. In this manner, surprisingly large amounts of charge can be quickly and highly reproducibly acquired by the toner particles.

The electrical potential pattern bearing member, also referred to as the receptor member, used in this invention may be comprised of a variety of dielectric or semiconducting materials including polymeric sheets, especially polyester sheets, elastomeric materials, glass, epoxy materials, dielectric coating such as aluminum oxide, silicon dioxide, zinc oxide, constructions comprising dielectric coatings on paper, and the like. Also the receptor member may be comprised of a photoconductive material either alone or disposed in an insulating binder, for example, arsenic selenide, titanium dioxide, selenium, cadmium sulfide, and organic photoconductors such as poly-N-vinylcarbazole, above or in combination with trinitrofluoroenone. Similarly, the receptor member may be composed of composite photoconductors such as a layer of poly-N-vinylcarbazole over a layer of selenium or composite materials such as a layer of polyester over a layer of cadmium sulfide in a binder. Protective topcoats may exist on the surface of the receptor member as long as they do not prohibit the development of the latent electrical potential pattern. Generally, the receptor member should be capable of bearing a latent electrical potential pattern for a time sufficient to allow development to occur. The receptor member may be self-supporting or be supported by a conductive layer during development. It may be in the form of an endless belt, a web, a sheet, or bound to a cylindrical drum. Many receptor members suitable for the practice of this invention are well known to those skilled in the arts of electrographics and electrophotography.

Developers suitable for the practice of this invention are generally described as one-component developers of magnetically attractable, electronically insulating toner particles having a static electrical conductivity, as determined according to the technique described at column 3, line 54 through column 4, line 47 of U.S. Pat. No. 3,639,245 to Nelson, generally less than $10^{-11}$ mhos/cm. and preferably less than $10^{-12}$ mhos/cm. at an electric field of about 10,000 volts per centimeter. Such toner particles may be also characterized by the dynamic steady state current measurement that has been described. To be applicable to the practice of this invention, the toner particles should exhibit an increase in dynamic steady state current of generally a factor of 5 and preferably a factor of 10 or more in response to a change in conductive shell linear surface speed from 5 cm./sec. to 50 cm./sec. when the electric field in the apparatus that has been described for making the dynamic steady state current measurements is about 10,000 volts per centimeter.

Suitable toner particles are generally comprised of particles of thermoplastic material which has a finely divided magnetically attractable material, such as magnetite, dispersed on or within the particles. Suitable thermoplastic materials include bisphenol-A-epoxy resins such as Epon epoxy resin (tradename of Shell Chemical Company), polystyrenes, polyethylenes, polyamides, polyesters, and the like.

The toner particles may be heat fusible or pressure fusible and can be spherical in shape. The largest diameter of the toner particles may suitably range from about 0.5 micrometers to about 100 micrometers, preferably from about 2 micrometers to about 35 micrometers. The size distribution may be wide or narrow depending on the tonal rendition desired in the developed image. Localized electric charge acceptor sites on the toner particles may improve the efficiency of charge injection and may be provided by small conductive particles, such as conductive carbon, fixed on the surface of the particles. These small conductive particles may also be dispersed throughout the bulk of the composite toner without strongly affecting the static conductivity of the particles. The addition of said charge acceptor sites to the surface of the toner particles may functionally increase the charge injection and transport efficiency of these toner particles and may provide for a higher charge density on the toner particles during development. This behavior can be seen by considering toners E and F in FIGS. 6 and 9. Toner E has no carbon particles for providing charge acceptor sites whereas toner F has 0.33 percent by weight conductive carbon particles embedded in the surface layer. While toner E has greater static conductivity than toner F as shown in FIG. 6, FIG. 9 shows that the addition of charge acceptor sites to toner F allows it to exhibit the greater motion dependent electric current.

A one-component developer of electrically insulating, magnetically attractable toner particles for use in this invention can be made according to the teachings and specifications of U.S. Pat. No. 3,639,245 to Nelson with the exception that only enough fine conductive particles are attached to the surface layer of the particles so that the static conductivity is below about $10^{-12}$ mhos/cm. at a field of about 10,000 volts per centimeter.

A preferred source of magnetic attraction for source 15 used in the embodiments described has a uniform magnetic field along its axial length and strong fields around its circumference. One configuration satisfying these requirements is described in U.S. Pat. No. 3,455,276 to Anderson wherein a plurality of prismatic segments as described in the patent are permanently magnetized as indicated in FIG. 2 of the patent and formed into a cylindrical force producing member. Other suitable permanent magnetic materials include magnetizable ceramics and rare earth compounds. In general, the magnetic force producing member is mounted on a supporting shaft and it may either be fixed in an optimized stationary position or rapidly rotated about its central axis. Magnet rotation in addition to the shell rotation is generally preferred, since it minimizes constrictions in the toner particle flow that can occur as the developer material is metered onto the electrode-developer transport means.

In the practice of this invention, it is preferred that toner particles in the development region experience a magnetic force of attraction of about $10^{-5}$ dynes or more. Other suitable sources of magnetic attraction may take other forms and sizes as well as employing electromagnets.

Examples of suitable materials comprising the electrically conductive portion 8 of the electrode-developer transport means 6 are metals such as aluminum, copper, gold, silver, non-magnetic steel, brass, and the like. Also, non-metallic materials that are electrically conductive are suitable such as conductive rubbers, conductive polymers, and conductive carbon. The resistivity of these conductive portions should be less than about $10^5$ ohm-centimeters and preferably less than $10^2$ ohm-centimeters.

The conductive portion 8 of the electrode-developer transport means 6 may be in a variety of shapes and sizes such as circular cylindrical shells, belts, plates, blades, and said portion may also be provided with a variety of surface finishes such as polished, sand-blasted, knurled and said surface may comprise a plurality of pin-like projections and also may be comprised of physically separated regions of alternating electrically conductive and electrically insulating material.

In cases where a portion 7 of electrode means 6 is present, such portion may act as a mechanical support structure for the developer particles and in these cases may be comprised of electrically insulating or electrically conductive material or both. Suitable materials for the electrically insulating portions of portion 7, when present, are a variety of plastics, solid phenolics, polymers such as polyester, nylon, teflon, and the like.

As illustrated and described above, there are at least two major factors which influence the electrical transport and, hence, the rate of accumulation of electric charge acquired by the toner particles used in this invention. One is the physical mixing action experienced by the toner particles in the development region and another is the magnitude of the electric field on the toner particles in the development region. In general, increasing either the rate or degree of toner motion or increasing the magnitude of the said electric field, while the toner particles are in rapid, relatively turbulent motion as a result of said physical mixing action, will increase the electrical charge transport.

One way the desired rapid, turbulent motion of the toner particles can be obtained is by a rapid physical displacement of the portion of the electrode-developer transport means that is used to transport the toner particles. Another method involves rapid physical displacement of both the toner transporting portion of the electrode-developer transport means and the magnetic force producing member. In the case where the electrode-developer transport means comprises a shell, and only the shell is rotated, its linear surface speed should be at least 10 cm./sec. and preferably at least 20 cm./sec. As has been indicated, when the electrode-developer transport means comprises a shell and the magnetic force producing member is a cylindrical body that is also rotated, the linear surface speed of the shell can be reduced slightly to obtain similar performance. When rotated, the magnetic force producing member must be rotated at a high enough rate to minimize any density variations in the developed image caused by changing magnetic forces in time in the development region. For fixed rotational speeds of the electrode-developer means and/or the magnetic force producing member, increased deposition of the toner particles is possible either by the addition of one or more like development apparatus or by multiple development passes with a single development apparatus.

Another method of improving image development by increasing electrical charge transport onto and by the toner particles is to increase the electric field in the development region which increases the electric charge injection from the conductive portion of the electrode-developer transport means onto the toner particles and between toner particles. This may be accomplished by controlling the sources of electrical potential present in a given embodiment so that the potential difference between the electrode means and the image areas of the surface 4 of the potential pattern bearing member 1 is increased. In the case where two sources of electrical potential are present, such as in the second embodiment referred to in FIG. 3, wherein portion 29 is insulating and portions 8 and 28 are conducting, the amount of electrical charge on the toner particles is determined by the potential difference between the two voltage sources 10 and 30, such potential difference beng generally greater than about 100 volts and preferably greater than about 200 volts.

Yet another method of increasing electrical charge transport onto and by the toner particles is to increase the electric fields in the development region by means of reducing the spacing between the surface 13 of the electrode means 6 and the surface 4 of the potential pattern bearing member 1. This spacing should be small enough to provide for sufficient charge injection and large enough to prevent uncontrolled electrical breakdown of the materials in the development region. These considerations, in general, depend upon the specific geometry of an embodiment and the electrical properties of the materials involved. In the first embodiment discussed above, in reference to FIG. 2, the spacing should be between $25 \times 10^{-4}$ centimeters and $50 \times 10^{-2}$ centimeters and preferably between $50 \times 10^{-4}$ centimeters and $10 \times 10^{-2}$ centimeters. In all cases, the spacing should be at least greater than and preferably five times the maximum toner diameter.

In general, in a given embodiment of this invention, the sources of electrical potential and the above-mentioned spacings between the surface 13 of the electrode means 6 and the surface 4 of the potential pattern bearing member 1 should be chosen and controlled very carefully for optimum development quality. In particular, the above said spacing should be constant and uniform over the extent of the development region to an accuracy of generally 25 percent and preferably less than 10 percent.

In the practice of this invention, it has been observed that the degree to which large solid areas of the electrical potential pattern are filled in with toner particles in controllable and may range from development having a strong edge effect wherein the solid areas are not filled in completely to developments having high fidelity wherein said solid areas are completely and reproducibly developed. The selection of the development gap plays a major role in determining the degree of development in solid areas. In general, smaller development gaps result in more development of solid areas.

In the process of this invention, it has been discovered that it is undesirable and indeed markedly detrimental to the quality of the developed image if there is physical displacement, either undulating of unidirectional, of the developer transport portion of the electrode-developer transport means transverse to the direction of movement of the potential pattern bearing member such that the development gap changes substantially in the period of time during which development takes place. Such motion should be minimized or eliminated.

Since the toner particles used in the process embodying the invention are insulating, they can be expected to acquire some charge due to frictional or triboelectric action as the toner particles rub against a dissimilar material such as the surface of the potential pattern bearing member. The magnitude and polarity of any triboelectrically acquired charge is dependent on the dissimilar materials involved and the degree of rubbing that takes place. This triboelectric action may be harmful or may be beneficial to the process dependent on to which polarity the toner must be charged. For example, if a negative charge on the toner particles is required for development, the presence of triboelectric interaction causing the toner particles to acquire some positive charge would be undesirable. It has been found, however, that the process of this invention permits the insulating toner particles to electrically acquire such a high charge density of either polarity that the magnitude of any triboelectrically acquired charge will be only a minor contribution to the total charge on the particles and, therefore, not adversely affect the controlled development of high contrast images.

The process of this invention has the capability of attaining high development speeds, wherein the receptor member is moved, on the order of 100 cm./sec. with a single development apparatus and much higher when multiple development apparatus are used. The process is also adapted to develop images at speeds as low as 5 cm/sec. or slower. Referring to the embodiment in FIG. 2, the width of the contact region 22 between the toner particles and the potential pattern bearing member may be typically about 1.0 centimeter at a process speed of 100 cm./sec., process speed being the rate of motion of the receptor member 1 in direction 17. The dwell time in this case for a surface region of surface 4 in the toner particles is around $10^{-2}$ seconds. This period of time is surprisingly short for development using electrically insulating toner particles compared to convention development processes using such material. Thus, one major advantage of the present process is the very high efficiency of both charging the toner particles and their deposition on the receptor member.

As mentioned above, the magnitude and polarity of electrical charge acquired by the toner particles in this process is determined by, among other things, the values of the electrical potential provided by the voltage sources, whereas in many conventional development processes, the polarity of the charge and in some cases the magnitude is determined predominately and effectively by the triboelectric behavior of the toner particles to be deposited with respect to various other materials present. It has been discovered in the practice of this process, that both positive and negative type developments of the same electrical potential pattern with the same toner particles are possible by altering the value and/or polarity of the source of electric potential. For example, referring to the embodiment of FIG. 2, when the image areas have a relatively high positive electrical potential and the non-image areas have a potential of about zero (ground) and the voltage provided by the source 10 is at about ground, substantial deposition of toner particles results in the image areas and very little deposition of toner particles in the non-image areas. However, when the voltage source 10 provides an electrical potential in terms of magnitude and polarity that is near the relatively high electrical potential of the image areas, a negative development is obtained in which a substantial amount of the toner particles is deposited in the non-image areas (potential of about zero) with a very little amount deposited in the image areas (relatively high potential).

The developed image may be bonded to the receptor member directly or transferred to a secondary substrate for bonding thereto or for further transfer. Permanent bonding of the toner particles to a substrate can be accomplished by conventional fixing techniques such as pressure, heat, or combinations thereof, or by use of chemical bonding agents or by bonding a sheet or film over the surface of the developed image.

Typical uses of the process of this invention include a variety of uses in the reprographics and copying fields, such as image development in copying machines, high speed duplicators, microfilm hard copy machines, and the like. Another use is in the field of electrographic recording and, in particular, the development of potential patterns generated by a stylus or styli depositing electrical charge onto a dielectric medium. Such devices are employed as computer printers, plotters, and facsimile machines. In general, highly effective use of the process of this invention is possible when it is desired to physically reveal or develop latent images comprised of electrical potential patterns.

The following non-limiting examples are presented to further illustrate some of the principles and embodiments of this invention.

EXAMPLE 1

This example illustrates that the magnitude and polarity of electrical charge acquired by one-component developers of insulating, magnetically attractable toner particles applicable in the practice of this invention is in accordance with the electric fields experienced by the toner particles in the development region. This is shown by using a single developer apparatus and simultaneously depositing one-component developers of insulating, magnetically attractable toner particles on a relatively highly positively charged portion of a surface and on a relatively highly negatively charged portion of a surface, while depositing none of the toner particles on an uncharged portion of the surface.

Figure 11:
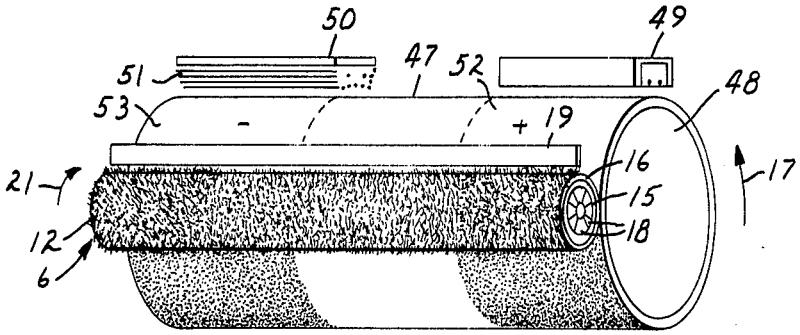
FIG. 11 is a schematic view of apparatus used for developing on a variably charged polyester surface.

The apparatus used and the developed pattern obtained is depicted in FIG. 11. A sheet of $2.5 \times 10^{-3}$ centimeter thick polyester film 47 (22 cm. wide by 40 cm. long) (available from E. I. du Pont de Nemours and Co., Inc., under the tradename MYLAR) is coated on one surface with a thin film of electrically conductive aluminum and wrapped around the periphery of a 20.3 centimeter diameter cylindrical, rotatable, aluminum support drum 48 with the aluminum coated side of said film against the support drum. The film composite is then taped in place and the aluminum support drum is electrically grounded. The film 47 and support drum 48 provide a structure corresponding to the receptor member 1 described in connection with FIGS. 1–5, inclusive. A shielded corotron 49 and a scorotron 50 having screen control wires 51 are positioned above the aluminum support drum such that each is capable of uniformly charging an area corresponding to approximately one-third of the polyester surface. With the support drum rotating counter-clockwise, as indicated by the arrow 17, so as to produce a linear surface speed of 20.3 cm./sec., the corotron 49 is adjusted to uniformly deposit an electric charge corresponding to about +2000 volts on the portion 52 of the polyester surface passing under said corotron and the scorotron 50 is adjusted to uniformly deposit a charge corresponding to about −2000 volts on the portion 53 of the polyester surface passing under said scorotron. No charge is detected on the polyester surface situated between the corona generating devices resulting in a zero voltage in that portion. After passing the corona generating devices, the potential bearing polyester surface continues past the electrode-developer transport means 6 which is of the form used for the electrode-developer transport means 6 in FIG. 2.

The shell 16 of the electrode-developer transport means 6 is of stainless steel and has an outside diameter of about 3.18 centimeters and a length of about 24 centimeters. The magnetic source 15 is stationary and positioned as described in connection with the apparatus of FIG. 2. The diameter of the magnetic source 15 is about 2.84 centimeters and its maximum radial magnetic field is about 700 gauss. To uniformly meter toner particles on the shell 16, element 19, in the form of a rectangular aluminum blade, is positioned in the location shown. The minimum spacing between the edge of blade 19 and the shell 16, i.e., the doctor gap, is a uniform 0.030 centimeter. The minimum spacing between the shell 16 and the surface of the polyester layer 47, i.e., the development gap, is uniform and about 0.053 centimeter. Blade 19 and shell 16 are both connected to electrical ground (not shown). In this example, the toner particles 12 are type F referred to in FIG. 6 and Table I and, as such, are electrically insulating.

Viewed from the right end, as shown in FIG. 11, the shell 16 is rotated clockwise, as shown by arrow 21, so as to produce a constant linear surface speed of about 25 cm./sec. A dense uniform layer of toner particles 12 are deposited in area 52 of the polyester charged to about +2000 volts and an equally dense uniform layer of toner particles 12 is deposited in area 53 of the polyester charged to about −2000 volts. No deposition of the toner particles occurs in the areas having about zero volts. Subsequent measurement verified that the toner particles 12 deposited in the +2000 volt area 52 were negatively charged and that the toner particles deposited in the −2000 volt area 53 were positively charged.

EXAMPLE 2

This example demonstrates the manner in which the amount of toner particles deposited on a uniformly charged surface increases with increasing shell surface speed when using a one-component developer of insulating, magnetically attractable toner particles and is independent of shell surface speed when using a one-component developer of conductive, magnetically attractable toner particles, all other conditions being equal.

The apparatus and conditions of Example 1 are employed with the exception of varying the type of toner particles and the shell surface speed. Relatively insulating and relatively conductive, magnetically attractable toner particles are employed at separate times. The insulating, magnetically attractable toner particles are the same as that used in Example 1 and are of the type F referred to in FIG. 6 and Table I. The conductive, magnetically attractable toner particles are of the type A referred to in FIG. 6 and Table I.

The procedure is as follows. A sufficient quantity of insulating, magnetically attractable toner particles is placed on the shell 16 and the shell linear surface speed is selected. As in Example 1, a $2.5 \times 10^{-3}$ centimeter thick polyester sheet 47 with an aluminum backing is then taped to the aluminum support drum 48. With the aluminum drum moving at a linear surface speed of about 20.3 cm./sec., the polyester sheet passes under the corona generators to acquire the +2000 volt, 0 volt, −2000 volt potential pattern and then continues past the grounded developer apparatus to form a developed image corresponding to the potential pattern. The polyester sheet is then removed from the aluminum support drum and the deposited toner is subsequently fixed to the polyester sheet by placing the sheet over a hot blanket at about 110° C. for several seconds. A new sheet of polyester film is then taped to the aluminum support drum, a different developer shell surface speed is selected, and another sample is generated. After several developed polyester sheets are obtained using various shell surface speeds, the insulating, magnetically attractable toner particles are replaced by the conductive, magnetically attractable toner particles and the procedure repeated. The electrically conductive aluminum film is removed from the backside of each polyester sample containing developed and fixed toner particles by wiping with a sodium hydroxide solution. The polyester samples are then placed on a white paper sheet having a diffuse reflection optical density of 0.16 units and the diffuse reflection optical density of the toner particles deposited in the +2000 volt, 0 volt, and −2000 volt regions is measured for each sample. The results are tabulated in Table II and shown graphically in FIG. 10.

TABLE II

| TYPE OF TONER PARTICLES | SHELL SURFACE SPEED IN CENTIMETERS PER SECOND | DIFFUSE REFLECTION DENSITY OF TONER PARTICLES DEPOSITED IN AREAS OF THE POLYESTER CHARGED TO: | | |
|---|---|---|---|---|
| | | +2000 Volts | 0 Volts | −2000 Volts |
| TYPE F OF TABLE I | 1.3 | .20 | .16 | .22 |

TABLE II-continued

| TYPE OF TONER PARTICLES | SHELL SURFACE SPEED IN CENTIMETERS PER SECOND | DIFFUSE REFLECTION DENSITY OF TONER PARTICLES DEPOSITED IN AREAS OF THE POLYESTER CHARGED TO: | | |
|---|---|---|---|---|
| | | +2000 Volts | 0 Volts | −2000 Volts |
| (electrically insulating according to this invention) | 5.1 | .42 | .16 | .44 |
| | 12.7 | .82 | .16 | .86 |
| | 25.4 | 1.21 | .16 | 1.25 |
| | 50.8 | 1.32 | .16 | 1.30 |
| | 76.2 | 1.36 | .16 | 1.36 |
| TYPE A OF TABLE I (electrically conductive according to this invention) | 1.3 | 1.46 | .16 | 1.46 |
| | 5.1 | 1.46 | .16 | 1.46 |
| | 12.7 | 1.46 | .16 | 1.46 |
| | 25.4 | 1.46 | .16 | 1.46 |
| | 50.8 | 1.46 | .16 | 1.46 |
| | 76.2 | 1.46 | .16 | 1.46 |

EXAMPLE 3

This example illustrates the effect of a significant reduction in shell surface speed when depositing an imagewise pattern of one-component developers of electrically insulating, magnetically attractable toner particles on a photosensitive potential pattern bearing member according to the process of this invention.

Elements similar to those depicted in FIG. 2 are employed wherein portion 2 of member 1 comprises a zinc oxide type sheet such as sold by Minnesota Mining and Manufacturing Company, Saint Paul, Minn., for use in its VQC series of copying machines and portion 3 of member 1 comprises an aluminum support drum having a diameter of 20.3 centimeters. The zinc oxide sheet is wrapped around the aluminum support drum and taped in place. In the dark, the sheet is electrostatically charged to about −600 volts by passing it under a corona discharge device. The sheet is then subjected to an imagewise pattern of light and dark using a tungsten light source, the maximum exposure in the light struck areas being about 0.18 millijoules/cm.$^2$ Immediately prior to passing the electrode-developer transport means 6, the surface potential pattern on the zinc oxide sheet corresponds to about −500 volts in the non-light struck areas and to about −50 volts in the light struck areas.

The electrode-developer transport means 6, the magnetic force producing member 15, and element 19 have the same components, dimensions, and relative positions with respect to the zinc oxide sheet as described in Example 1. The magnet sections 18 are stationary and positioned as indicated in Example 1. However, the doctor gap is a uniform 0.038 centimeter and the development gap is uniform and about 0.046 centimeter. A +500 volt d.c. bias potential is applied to shell 16 and blade 19. Toner particles 12 are present on the shell to the extent that a reservoir of excess toner exists on one side of blade 19. The toner particles 12 are, in this example, the type E referred to in FIG. 6 and Table I. The shell transporting the toner particles and acting as the electrically conductive portion of the electrode means rotates in a counter-clockwise direction with a linear surface speed of about 76.2 cm./sec. and the potential patterns bearing the charged zinc oxide sheet is rotated in a clockwise direction at a linear surface speed of 20.3 cm./sec. The resulting developed image has toner particles selectively deposited in the above-mentioned non-light struck areas where the potential is relatively high, whereas no toner particles are deposited in the light struck areas where the potential is only −50 volts. The resulting image is of good quality, having high density in the image areas and low background in the non-image areas, and uniformly-filled solid image areas. When the developed image is fixed to the zinc oxide sheet by placing the sheet over a hot blanket at about 110° C. for several seconds, a diffuse reflection optical density of 1.20 units is measured in said filled solid image areas.

The importance of rapid, turbulent physical mixing of the toner particles is illustrated by development of an image using the foregoing parameters except for a significantly reduced shell linear surface speed. For example, a low contrast image having a maximum diffuse reflection optical density in filled solid image areas of 0.50 is obtained when the shell linear surface speed is reduced to 7.6 cm./sec.

EXAMPLE 4

Except as noted, the apparatus, procedure and the one-component developer of insulating, magnetically attractable toner particles employed in Example 3 are used to develop in an imagewise manner on a polyvinylcarbazole-trinitrofluorenone (PVK-TNF) photosensitive member. The photosensitive member is a 15 micrometer thick film consisting essentially of a 1:1 ratio of one monomer unit of poly-n-vinylcarbazole to one molecule of 2,4,7-trinitro-9-fluorenone. This film is coated on a thin film of electrically conductive aluminum which in turn has been coated on a flexible polyester support layer. The composite construction is wrapped around the 20.3 centimeter diameter aluminum support drum with the polyester surface contacting the drum. The film composite is then taped in place and the conductive aluminum layer connected to electrical ground. Immediately prior to passing the shell bearing the developer, PVK-TNF layer is electrostatically charged and exposed to a light pattern to provide a charge pattern corresponding to a potential of about −800 volts in the non-light struck or image areas and a potential of about −50 volts in the light struck or background areas of the PVK-TNF surface.

The doctor gap is adjusted to be a uniform 0.028 centimeter and the development gap is adjusted to be uniform and about 0.043 centimeter. A d.c. bias potential of +100 volts is applied to the conductive shell and the aluminum blade. The resultant developed PVK-TNF film contains a uniform and high density deposition of the toner particles in the high potential non-light struck areas and no deposition in the low potential light struck areas.

EXAMPLE 5

This example illustrates the ability to make a reversal development of the potential pattern bearing member used in Example 4. The conditions of Example 4 are repeated except that prior to development, the bias potential on the conductive shell and the aluminum blade is −900 volts. This provides a potential difference of about 100 volts between the non-light struck areas of the PVK-TNF surface and the conductive developer shell whereas in the light struck areas, the potential difference is about 850 volts. The differentially charged PVK-TNF layer moves past the shell bearing the toner particles as in Example 4. The resultant developed image pattern is a reversal or "negative" of the developed image pattern obtained in Example 4. A dense, uniform layer of toner particles is deposited in the light struck, low potential areas of the sample and no deposition occurring in the non-light struck, high potential areas of the sample.

EXAMPLE 6

Except as noted, the apparatus and procedure employed in Example 3 are used to deposit the one-component developer of insulating, magnetically attractable toner particles in an imagewise manner on a composite photosensitive member that is available from the Katsuragawa Electric Company, Ltd., Tokyo, Japan, which includes a thin cadmium sulfide photoconductive formulation secured to a conductive layer. A thin dielectric overlayer, which may be a polyester, is provided on the cadmium sulfide formulation. The photosensitive member is charged according to the Katsuragawa process, which is well known, and described in a number of patents including U.S. Pat. No. 3,457,070, to provide a potential of −320 volts in the light struck areas and a potential of +80 volts in the non-light struck areas of the polyester surface. The toner particles used are the same as that employed in Example 1. With the exception of optimizing the position of the stationary magnetic roll and adjusting the development gap to be uniform and about 0.030 centimeter, the location of the various components and the relative direction of rotation of the shell and the photosensitive construction are unchanged. The shell surface speed is 63.5 cm./sec. The stainless steel shell and aluminum blade are both connected to electrical ground, and the differentially charged photosensitive construction moves past the developer apparatus at a linear surface speed of 12.7 cm./sec. A high contrast image is developed with a dense, uniform layer of toner particles being deposited in the areas charged to −320 volts with no deposition occurring in areas charged to +80 volts.

EXAMPLE 7

Except as noted, the apparatus and procedure described for Example 3 are used for this example which illustrates the ability to develop a positive or a negative image on a composite photosensitive construction by switching only the polarity of the bias voltage applied to the conductive portion of the electrode-developer transport means.

The photosensitive member is the same as used in Example 6. The composite photosensitive construction was sensitized according to the Katsuragawa process to provide a potential of −230 volts in the light struck areas and a potential of +230 in the non-light struck areas of the polyester surface. The type D toner particles of FIG. 6 and Table I are used.

With the exception of optimizing the position of the stationary magnetic roll and adjusting the development gap to be uniform and about 0.046 centimeter, the location, shape, and size of the various components are unchanged as is the relative direction of rotation of the shell and the photosensitive construction. The shell surface speed is 63.5 cm./sec.

The stainless steel shell and the aluminum blade are biased at −250 volts d.c. and the differentially charged photosensitive construction moves past the developer apparatus at a linear surface speed of 12.7 cm./sec. A high contrast "positive" image is developed with toner particles being deposited in areas corresponding to +230 volts and no deposition occurring in the −230 volt areas of the polyester surface. The developed image is electrostatically transferred to a plain paper sheet using a positive corona discharge device and fixed to the sheet by placing the sheet over a hot blanket at about 110° C. for several seconds. The maximum diffuse reflection optical density in the areas in which toner particles were deposited is 1.20 units, while the diffuse reflection optical density in the areas not receiving any of the toner particles is 0.07 units.

The above steps are repeated except that the shell and blade are biased at +250 volts d.c. A high contrast "negative" image is developed with toner particles being deposited in areas corresponding to −230 volts and no deposition occurring in areas corresponding to +230 volts. The developed image is electrostatically transferred to a plain paper sheet using a negative corona discharge device and fixed to the sheet by placing the sheet over a hot blanket at about 110° C. for several seconds. The maximum diffuse reflection optical density in the areas in which the toner particles were deposited is 1.30 units. Both the negative and positive prints exhibit high contrast with uniform, high density solid fill.

EXAMPLE 8

This example describes conditions for developing on an arsenic selenide photosensitive member moving at high speed. Except as noted, the apparatus and procedure employed in Example 3 are used. The photosensitive member consists of a 65 micrometer thick layer of evaporated amorphous arsenic selenide coated on the aluminum support drum. The arsenic selenide layer is sensitized and exposed to a light pattern such that immediately prior to passing the electrode-developer transport means 6, a surface potential pattern exists corresponding to about +1000 volts in the non-light struck areas and to about +100 volts in the light struck areas. The doctor gap is adjusted to be a uniform 0.028 centimeter and the development gap is adjusted to be uniform and about 0.038 centimeter. The linear surface speed at the shell is fixed at 88.9 cm./sec. A bias potential of −250 volts d.c. is applied to the shell and the aluminum blade. The insulating, magnetically attractable toner particles employed in this example are toner D of FIG. 6 and Table I. The differentially charged arsenic selenide surface moves past the shell bearing the toner particles at a linear surface speed of 76.2 cm./sec. The resultant developed film contains a uniform and high density deposition of the toner particles in the high potential non-light struck areas with no deposition occurring in the low potential light struck areas of the surface.

EXAMPLE 9

Figure 12:
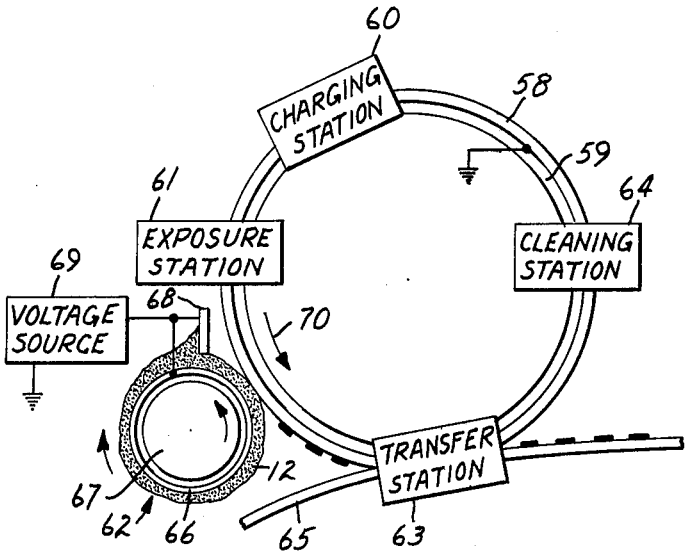
FIG. 12 is a schematic cross-sectional view of another embodiment of an apparatus for carrying out a process using this invention.

Examples 9, 10, 11 and 12 involve the use of an apparatus as depicted in FIG. 12. These examples show the versatility of this development process in that the same type of toner particles and mechanical specifications are used for each example to obtain sharp, high contrast electrostatically transferred copies using several different photosensitive constructions.

The photosensitive receptor member indicated at 58 in this example is a zinc oxide type construction sold by Konishiroku Photo Industries Co., Ltd., for use in its U-Bix 480 copier. This construction consists of a dye sensitized zinc oxide in a resin binder which is coated on a thin aluminum layer, the aluminum layer in turn being attached to a flexible support layer. The photosensitive member 58 is wrapped around a 15.2 centimeter in diameter electrically grounded, aluminum support drum 59 and taped in place. The aluminum layer of the photosensitive member is then electrically connected to the support drum. Positioned around the support drum 59 are a sensitizing or charging station 60 to electrostatically deposit a uniform charge density of predetermined polarity on the photosensitive member 58, an exposure station 61 to provide an imagewise pattern of light and dark to produce a corresponding charge pattern on the photosensitive member 58, a developer apparatus 62 to develop the charge pattern, a transfer station 63 to electrostatically transfer the developed charge pattern to a plain paper sheet 65, and a cleaning station 64 to clean and recondition the photosensitive member 58 for repeat cycling. Details are not provided with respect to the stations 60, 61, 63 and 64 as these can take on any of a number of suitable forms which are well known in the electrostatic copy machine art.

The apparatus of FIG. 12 is mounted and operated in a light-tight enclosure (not shown). The support drum 59 rotates at a linear surface speed of 15.2 cm./sec. past the charging station 60 and the exposure station 61 so that prior to passing the developer apparatus 62, the zinc oxide surface has a potential pattern corresponding to about −520 volts in the non-light struck areas and to about −40 volts in the light struck areas. The developer apparatus 62 consists of a rotatable electrically conductive stainless steel cylindrical shell 66 surrounding a rotatable magnet roll 67. The magnet roll is a magnetizable ceramic material that is magnetized to present alternate North and South poles about its circumference. The circumferential magnetic field distribution is then similar to that shown in FIG. 4 of U.S. Pat. No. 3,455,276. The magnetic field is uniform along the axial length of the magnet. The maximum radial magnetic field of said magnet roll is about 800 gauss. The stainless steel shell 66 has an outside diameter of 3.18 centimeters and the magnet roll 67 has a diameter of 2.80 centimeters. An aluminum blade 68 is positioned in the location shown in FIG. 12 and spaced such that the doctor gap is a uniform 0.030 centimeter. The spacing between the developer shell and the surface of the photosensitive member 58 is adjusted to be uniform and about 0.043 centimeter. A voltage source 69 is connected to the shell 66 and aluminum blade 68 to provide a 100 volt d.c. bias on the shell and blade. The bias polarity is opposite to the polarity which the photoconductor is electrostatically charged. Toner particles 12 are supplied to the shell 66 from a source that is not shown. Type F toner particles referred to in FIG. 6 and Table I are used. The photosensitive member is rotated in a counter-clockwise direction as shown by arrow 70, while the shell carrying the toner particles 12 is rotated in a clockwise direction at a linear surface speed of 63.5 cm./sec. and the magnet roll is rotated in a counter-clockwise direction at a rate of about 1500 revolutions per minute.

After the differentially charged zinc oxide surface moves past the developer apparatus 62 at a linear surface speed of 15.2 cm./sec., it has a dense, uniform layer of toner particles 12 deposited in the high potential or non-light struck regions of the sheet with no deposition occurring in the low potential or light struck regions of the sheet.

The deposited toner particles are electrostatically transferred to a white plain paper sheet using a negative corona discharge at the transfer station 63. The resultant transferred image is of good quality, having dense, uniformly filled solid areas and sharp well-defined edges. Also, the continuous tone (gray scale) areas are well reproduced. The developed image is fixed to the paper sheet using a combination of pressure and heat such that the resultant copy has a maximum diffuse reflection optical density of 1.46 units in filled solid areas as compared to a diffuse reflection optical density of 0.07 units in the areas where there was no deposition of the toner particles.

EXAMPLE 10

The conditions and process of Example 9 are repeated except that a polyvinylcarbazole-trinitrofluorenone photosensitive member is used in place of the zinc oxide member 58. The polyvinylcarbazole-trinitrofluorenone (PVK-TNF) photosensitive member is the same as described in Example 4. As with zinc oxide, it was attached to the support drum 59 with its conductive aluminum layer electrically connected to the support drum. The PVK-TNF layer was charged at station 60 and exposed to an imagewise pattern of light and dark at station 61 such that prior to passing the developer apparatus 62, a surface potential pattern existed corresponding to about −900 volts in the non-light struck areas and to about −80 volts in the light struck areas. After the differentially charged PVK-TNF surface moves past the developer apparatus 62, it has a dense, uniform layer of toner particles deposited in the high potential or non-light struck regions of the surface with no deposition occurring in the low potential or light struck regions of the surface.

The resultant transferred image is of good quality, having dense, uniformly filled solid areas and sharp well-defined edges. Also, the continuous tone (gray scale) areas are well reproduced. As in Example 9, the developed image is fixed to the paper sheet using a combination of pressure and heat such that the resultant copy has a maximum diffuse reflection optical density of 1.42 units in filled solid areas as compared to a diffuse reflection optical density of 0.07 units in the areas where there was no deposition of the toner particles.

EXAMPLE 11

The conditions and the process of Example 9 are repeated except that a selenium photosensitive member is used in place of the zinc oxide member, the charging station 60 provides a uniform positive charge on member 58 and a positive corona discharge is used at the transfer station 63. In this example, the photosensitive member 58 consists of a 65 micrometer thick layer of evaporated amorphous selenium coated on the aluminum support drum 59. The selenium layer is sensitized at station 60 and exposed to an imagewise dark and light pattern at exposure station 61 such that prior to passing the developer apparatus 62, a surface potential pattern exists corresponding to about +1100 volts in the non-light struck areas and to about +100 volts in the light struck areas of the surface. After the differentially charged selenium surface moves past the developer apparatus 62, it has a dense, uniform layer of toner particles 12 deposited in the high potential or non-light struck regions of the surface with no deposition occurring in the low potential or light struck regions of the surface.

The transferred image is of good quality, having dense uniformly filled solid areas and sharp well-defined edges. The continuous tone (gray scale) areas are well reproduced. The developed image is fixed to the paper sheet using a combination of pressure and heat such that the resultant copy has a maximum diffuse reflection optical density of 1.36 units in filled solid areas as compared to a diffuse reflection optical density of 0.07 units in the areas where there was no deposition of the toner particles.

EXAMPLE 12

The conditions and the process of Example 11 are repeated except that an arsenic selenide photoconductor is used in place of the zinc oxide photoconductor. The photosensitive member 58 consists of a 70 micrometer thick layer of evaporated amorphous arsenic selenide coated on the aluminum support drum 59. The arsenic selenide layer was charged at station 60 and exposed to an imagewise dark and light pattern at exposure station 61 such that prior to passing the developer apparatus 62, a surface potential pattern existed corresponding to about +1000 volts in the non-light struck areas and to about +80 volts in the light struck areas of the surface. After the differentially charged arsenic selenide surface moves past the developer apparatus 62, it has a dense, uniform layer of toner particles 12 deposited in the high potential or non-light struck regions of the surface with no deposition occurring in the low potential or light struck regions of the surface.

The resultant transferred image is of good quality, having dense, uniformly filled solid areas and sharp well-defined edges. The continuous tone (gray scale) areas are well reproduced. The developed image is fixed to the paper sheet using a combination of pressure and heat such that the resultant copy as a maximum diffuse reflection optical density of 1.30 units in solid fill areas as compared to a diffuse reflection optical density of 0.07 units in the areas where there was no deposition of the toner particles.

EXAMPLE 13

Except as noted, the conditions and the process of Example 12 are used for this example to illustrate the second embodiment described with reference to FIG. 3 wherein portion 8 of the electrode-developer transport means 6 is electrically conductive and stationary and portion 28 of portion 7 is electrically insulating.

A $2.54 \times 10^{-3}$ centimeter thick polyester layer covers the surface of the stainless steel shell 66. As a result, the aluminum blade (68 in FIG. 12) functions as the conductive portion 8 of the electrode-developer transport means and is biased via the voltage source 69 at −325 volts d.c. with respect to ground. The conductive portion of the shell, i.e., the stainless steel layer, is biased at +400 volts d.c. with respect to ground using a voltage source (not shown) corresponding to the voltage source 30 shown in FIG. 3. When the differentially charged arsenic selenide surface moves past the developer apparatus 62, a dense, uniform layer of toner particles 12 is deposited on the regions of the arsenic selenide surface charged to about +1000 volts with very little of the toner particles deposited on the regions of the arsenic selenide surface charged to about +80 volts. The resultant transferred image is of good quality, having dense uniformly filled solid areas and sharp well-defined edge. Also, the continuous tone (gray scale) areas are well reproduced. The developed image is fixed to the paper sheet using a combination of pressure and heat such that the resultant copy has a maximum diffuse reflectance optical density of 1.35 units in filled solid areas as compared to a diffuse reflection optical density of 0.07 units in the areas where there is no deposition of the toner particles.

EXAMPLE 14

This example illustrates the development speed capabilities of the development process of this invention. Except as noted, the apparatus and procedure described in Example 3 are employed. The photosensitive member is the sensitized zinc oxide construction described in Example 9. Type F toner particles, the same as that used in Example 1, are used. The procedure is as follows: The sensitized zinc oxide construction is wrapped around the 20.3 centimeters in diameter aluminum support drum and taped in place with the aluminum layer of the photosensitive member electrically connected to the support drum which is grounded. In the dark, the zinc oxide surface is electrostatically charged and exposed such that prior to passing the developer apparatus, the surface potential pattern corresponds to a uniform −520 volts in the non-light struck regions and to about −20 volts in the light struck regions of the surface. After initially sensitizing the zinc oxide sheet, the changing corona and the exposure lamp are turned off so as not to effect additional passes of the developed zinc oxide surface.

Referring to FIG. 2, the magnetic roll 15 is rotated in a clockwise direction at a rate of about 1500 revolutions per minute and, therefore, opposite to the direction of rotation of the shell 16. The doctor gap is adjusted to be a uniform 0.028 centimeter and the development gap is adjusted to be uniform and about 0.041 centimeter. The shell 16 is rotated in a counter-clockwise direction at a linear surface speed of 55.9 cm./sec. and a +200 volt d.c. bias voltage is applied via the voltage source 10 to the shell 16 and aluminum blade 19.

The differentially charged zinc oxide sheet moves past the developer apparatus in the same relative direction as the shell 16 at a predetermined linear surface speed. Toner particles are deposited in the high potential or non-light struck areas of the surface with no deposition occurring in the non-light struck or low potential areas on the surface. The zinc oxide sheet is either removed from the support drum or immediately recycled past the developer apparatus to increase the deposition of the toner particles. Once the zinc oxide sheet is removed from the support drum, the developed image is fixed to the zinc oxide surface by placing the sheet over a hot blanket at about 110° C. for several seconds. The procedure is then repeated for another zinc oxide sheet, changing only the rate of travel of the zinc oxide sheet and/or the number of times it passes the developer apparatus. Following this procedure and these development conditions, a single pass by the developer apparatus at a linear surface speed of 6.3 cm./sec. resulted in a fixed developed image having a maximum diffuse reflection optical density of 1.16 units. A single pass by the developer apparatus at a linear speed of 76.2 cm./sec. resulted in a fixed image having a maximum diffuse reflection optical density of 0.70 units. Three passes by the developer apparatus at a linear surface speed of 76.2 cm./sec. produced a fixed developed image having a maximum diffuse reflection optical density of 1.02 units. Accordingly, ten passes by the developer apparatus at a linear surface speed of 203.2 cm./sec. produced a fixed developed image having a maximum diffuse reflection optical density of 1.10 units.

The results indicate that improved image quality can be obtained by the use of more than one developer apparatus positioned around a photosensitive construction and operated according to the process of this invention.

Various modifications and substitutions will become apparent to those skilled in the art without departing from the scope and teachings of this invention.

What is claimed is:

1. A process for selectively depositing toner particles on one surface of a layer of material in accordance with an electrical potential pattern presented at said surface, including the steps of:

1. positioning an electrode-developer transport means a short and relatively uniform distance from and in opposing relationship to said one surface of said layer of material, said electrode-developer transport means including at least one electrically conductive portion;
2. establishing a unidirectional electrical potential difference between said electrically conductive portion of said electrode-developer transport means and said one surface with an electrical means connected between the surface of said layer of material opposite said one surface and said conductive portion;
3. providing a relatively uniform magnetic force of attraction at said electrode-developer transport means in the region adjacent to said one surface;
4. providing a physically continuous path of one-component developer of magnetically attractable, electrically insulating toner particles between said one surface and said electrically conductive portion while imparting a rapid, turbulent physical mixing action to said toner particles for bringing said toner particles into repetitive electrical contact with said electrically conductive portion and for providing random relative motion and physical contact between said toner particles to produce an electrical charge on said toner particles of a polarity and of an amount sufficient to cause such charged toner particles to be attracted to said layer of material with a force sufficient to overcome the counterforce provided by said magnetic force of attraction; and
5. progressively presenting said one surface to said toner particles during step 4) whereby said charged toner is deposited on said one surface of said layer of material in accordance with the electrical potential pattern presented at said one surface.

2. The process of claim 1 wherein said toner particles include electrically conductive particles attached to the surface of said toner particles.

3. The process of claim 1 wherein said magnetic force of attraction is at least $10^{-5}$ dynes.

4. The process of claim 1 wherein said electrode-developer transport means includes a movable surface for transporting said toner for providing said path of developer between said one surface and said electrically conductive portion.

5. The process of claim 4 wherein said movable surface is moved at a linear surface speed in excess of 10 centimeters per second.

6. The process of claim 4 wherein said one electrically conductive portion is physically separated from said movable surface.

7. The process of claim 1 wherein said toner particles have a static conductivity of less than $10^{-12}$ mhos per centimeter at an electrical field of about 10,000 volts per centimeter.

8. The process of claim 1 wherein said toner particles used in the process provide a dynamic steady state current when such particles are carried by an electrically conductive transport surface which is rapidly moved at an increasing linear surface speed relative to an electrically conductive electrode spaced a relatively uniform distance from the transport surface while an electric field of about 10,000 volts per centimeter is present between the transport surface and the electrically conductive electrode with a magnetic field presented at said transport surface in the region adjacent said conductive electrode, such particles being continuously presented in a quantity to bridge the space presented between said transport surface and said electrode, said current increasing at least by a factor of 5 with an increase in the linear speed of the transport surface from about 5 to 50 centimeters per second.

9. The process of claim 1 wherein said electrode-developer transport means includes a rotatable cylindrical shell for transporting said toner between said one surface and said electrically conductive portion and said magnetic force of attraction is produced by a magnetic force producing means positioned within said shell.

10. The process of claim 9 wherein said magnetic force producing means is cylindrical in form.

11. The process of claim 9 wherein said shell is rotated to provide said mixing action of said toners.

12. The process of claim 9 wherein said shell is rotated and said magnetic force producing means is rotated at the same time to provide said mixing action of said toners.

13. The process of claim 12 wherein said shell and said magnetic force producing means are rotated at the same speed and direction.

14. The process of claim 9 wherein said shell is rotated to provide said mixing action of said toners and movement of said layer of material is provided in the direction of movement of said shell at its closest position to said layer of material.

15. The process of claim 9 wherein said shell is rotated to provide said mixing action of said toners and movement of said layer of material is provided in the direction opposite the direction of movement of said shell at its closest position to said layer of material.

16. The process of claim 14 wherein rotation of said shell is at a rate that provides a linear surface speed for said shell in excess of 10 centimeters per second.

17. The process of claim 9 wherein said shell is electrically conductive and provides said one electronically conductive portion.

18. The process of claim 1 wherein said unidirectional electrical potential difference is established in part by means including a direct voltage source connected between the surface of said layer of material opposite said one surface and said conductive portion.

19. The process of claim 15 wherein rotation of said shell is at a rate that provides a linear surface speed for said shell in excess of 10 centimeters per second.

* * * * *